US010124591B2

(12) United States Patent
Ito

(10) Patent No.: US 10,124,591 B2
(45) Date of Patent: Nov. 13, 2018

(54) PRINTER AND HEAD UNIT

(71) Applicant: BROTHER KOGYO KABUSHIKI KAISHA, Nagoya-shi, Aichi-ken (JP)

(72) Inventor: Masaharu Ito, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 19 days.

(21) Appl. No.: 15/464,714

(22) Filed: Mar. 21, 2017

(65) Prior Publication Data

US 2017/0282561 A1 Oct. 5, 2017

(30) Foreign Application Priority Data

Mar. 31, 2016 (JP) ..... 2016-073671

(51) Int. Cl.
*B41J 2/155* (2006.01)
*B41J 2/14* (2006.01)

(52) U.S. Cl.
CPC ..... *B41J 2/155* (2013.01); *B41J 2/1433* (2013.01)

(58) Field of Classification Search
CPC ..... B41J 2/1433; B41J 2/155
See application file for complete search history.

(56) References Cited

U.S. PATENT DOCUMENTS 7,434,909 B2 * 10/2008 Suzuki ..... B41J 2/155 347/40
8,038,247 B2 * 10/2011 Yamaguchi ..... B41J 2/0458 347/15
8,596,761 B2 * 12/2013 Kobayashi ..... B41J 2/14233 347/47
9,079,405 B2 * 7/2015 Kurosu ..... B41J 2/1603
9,409,430 B2 * 8/2016 Arimura ..... B41J 29/377

FOREIGN PATENT DOCUMENTS

JP 2000-190484 A 7/2000
JP 2008-143065 A 6/2008
JP 2014-188979 A 10/2014

* cited by examiner

*Primary Examiner* — Lamson Nguyen
(74) *Attorney, Agent, or Firm* — Scully, Scott, Murphy & Presser, P.C.

(57) ABSTRACT

A printer is disclosed. One printer includes a first head unit being elongate in a longitudinal direction. The first head unit has a first nozzle group having a plurality of first nozzles arrayed with a first pitch along the longitudinal direction. The printer includes a second head unit being elongate in the longitudinal direction. The second head unit has a second nozzle group having a plurality of second nozzles arrayed along the longitudinal direction. The second nozzle group includes a plurality of nozzle sets. Each of the plurality of the nozzle sets includes some of the plurality of second nozzles. The second nozzles in each of the plurality of the nozzle sets arrayed with the first pitch along the longitudinal direction. The plurality of the nozzle sets are arrayed with a second pitch along the longitudinal direction. The second pitch is different from the first pitch.

16 Claims, 15 Drawing Sheets

PRINTER AND HEAD UNIT

CROSS-REFERENCE TO RELATED APPLICATION

This application claims priority from Japanese Patent Application No. 2016-073671 filed on Mar. 31, 2016, the content of which is incorporated herein by reference in its entirety.

FIELD OF DISCLOSURE

Aspects disclosed herein relate to a printer a head unit.

BACKGROUND

There have been known printers including line-type ejection heads. Some of the known line-type ejection heads includes a plurality of head units positioned along a width direction of a recording medium.

In such an ejection head, one head unit partially overlaps another head unit in a conveyance direction. If nozzles of the one head unit are misaligned with their corresponding nozzles of the another head unit at the overlap area, a streak (e.g., a white streak or a black streak) tends to occur in an image formed by the nozzles positioned at the overlap area. In order to solve this problem, various methods for reducing occurrence of the streak have been proposed.

In one example, an ejection head includes a plurality of head units. The head units are disposed such that printable ranges of adjacent two of the head units in a width direction of the recording medium partially overlap each other. A nozzle pitch in one of the adjacent head units is greater than a nozzle pitch in the other of the adjacent head units. In this ejection head, at an overlap area where the adjacent head units partially overlap each other, particular nozzles of the one head unit are aligned with particular nozzles of the other head unit. Thus, the nozzles of the one and other head units are appropriately used depending on the locations with respect to the particular nozzles (i.e., a boundary). That is, on one side relative to the boundary, the one head unit is caused to eject ink from one or more of the nozzles thereof. On the other side relative to the boundary, the other head unit is caused to eject ink from one or more of the nozzles thereof. Such an ink ejection manner may reduce occurrence of the streak in an image formed by the nozzles positioned at the overlap area.

In another example, an ejection head includes a plurality of head units. The head units are disposed such that printable ranges of adjacent two of the head units partially overlap each other. At the overlap area of the ejection head, ink droplets are ejected from nozzles of both of the adjacent head units. At another area of the ejection head, ink droplets are ejected from nozzles of the one or the other of the adjacent head units. Ink droplets ejected from the nozzles of each of the adjacent head units positioned at the overlap area dispersedly land on a recording medium to form a joint of images formed by the nozzles of the one head unit and the nozzles of the other head unit, respectively. Therefore, nozzle misalignment between the head units may less affect the print result.

SUMMARY

Nevertheless, in the known method described as the one example, if a conveying mechanism cannot convey a recording sheet straightly due to its lack of precision in conveyance, it may be difficult to prevent occurrence of the streak in the image formed by the nozzles positioned at the overlap area. In the other known method described as the other example, if the head units are not positioned at their respective optimum positions, density unevenness may occur at the joint of the images formed by the respective head units.

Accordingly, some embodiments of the disclosure may minimize relative displacement between a dot and its corresponding dot to be formed by two head units, respectively, and surely reduce occurrence of density unevenness at an overlap portion where two images overlap each other.

According to one aspect of the disclosure, a printer includes a first head unit being elongate in a longitudinal direction. The first head unit extends from a first end of the first head unit in the longitudinal direction to a second end of the first head unit in the longitudinal direction. The first head unit has a first nozzle group having a plurality of first nozzles arrayed with a first pitch along the longitudinal direction. The first nozzle group is positioned between a center of the first head unit in the longitudinal direction and the second end of the first head unit in the longitudinal direction. The printer includes a second head unit being elongate in the longitudinal direction. The second head unit extends from a third end of the second head unit in the longitudinal direction to a fourth end of the second head unit in the longitudinal direction. The second head unit has a second nozzle group having a plurality of second nozzles arrayed along the longitudinal direction. The second nozzle group is positioned between the third end of the second head unit in the longitudinal direction and a center of the second head unit in the longitudinal direction. The second nozzle group is positioned next to the first nozzle group in a transverse direction orthogonal to the longitudinal direction. The second nozzle group includes a plurality of nozzle sets. Each of the plurality of the nozzle sets includes some of the plurality of second nozzles. The second nozzles in each of the plurality of the nozzle sets arrayed with the first pitch along the longitudinal direction. The plurality of the nozzle sets are arrayed with a second pitch along the longitudinal direction. The second pitch is different from the first pitch.

According to further aspect of the disclosure, a head unit includes a nozzle group A including a plurality of nozzles A and a nozzle group B including a plurality of nozzle sets, each plurality of nozzle sets including of a plurality nozzles B. The head unit is elongate in a longitudinal direction. The head unit extends from a first end of the head unit in the longitudinal direction to second end of the head unit in the longitudinal direction. The plurality of nozzles A are arrayed with a first pich along the longitudinal direction. The nozzle group B is positioned between the first end of the head unit in the longitudinal direction and the nozzle group A. The plurality of nozzles B in each of the plurality of nozzle sets are arrayed with the first pitch along the longitudinal direction. The plurality of nozzles sets are arrayed with a second pitch along the longitudinal direction. The second pitch is different from the first pitch.

DETAILED DESCRIPTION

An illustrative embodiment will be described with reference to the accompanying drawings. Hereinafter, a direction extending along a conveyance direction in which a recording sheet 100 is conveyed is defined as a front-rear direction of a printer 1. A width direction of the recording sheet 100 is defined as a right-left direction of the printer 1. A direction orthogonal to the front-rear direction and the right-left direction is defined as a top-bottom direction of the printer 1.

<General Configuration of Printer>

Figure 1:
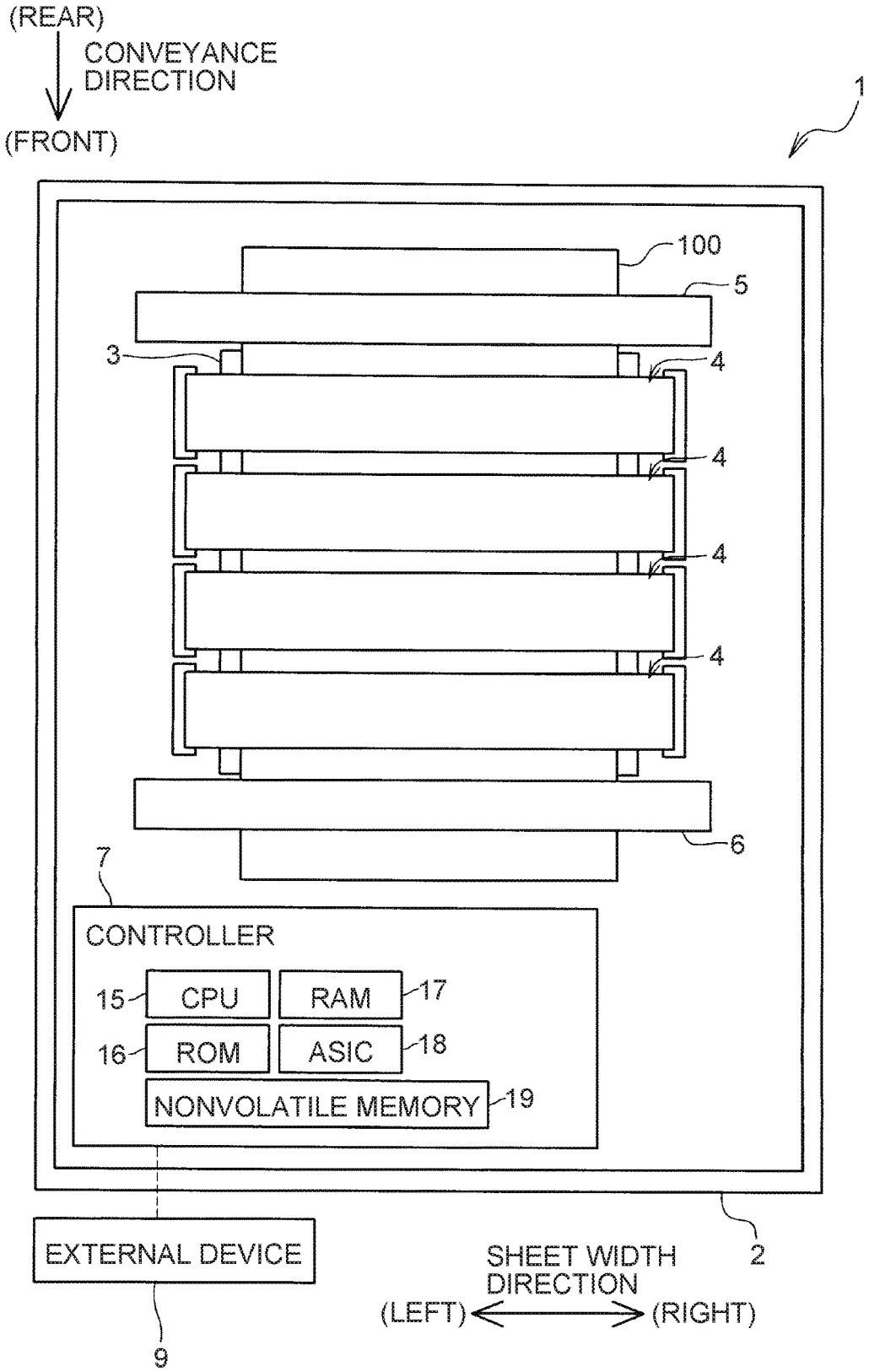
FIG. 1 is a schematic plan view of a printer in an illustrative embodiment according to one or more aspects of the disclosure.

As illustrated in FIG. 1, the printer 1 includes a platen 3, a plurality of, for example, four inkjet heads 4, a plurality of, for example, two conveyor rollers 5 and 6, and a controller 7, which are accommodated in a housing 2 of the printer 1.

The platen 3 is configured to support a recording sheet 100 on an upper surface thereof. The inkjet heads 4 are positioned above the platen 3 and next to one another in the conveyance direction. Each inkjet head 4 is configured to be supplied with ink from a corresponding one of ink tanks (not illustrated). Each inkjet head 4 is supplied with ink of different one of colors (e.g., black, yellow, cyan, and magenta). That is, the inkjet heads 4 are configured to eject ink of respective different colors.

The controller 7 includes a central processing unit ("CPU") 15, a read only memory ("ROM") 16, a random access memory ("RAM") 17, and an application specific integrated circuit ("ASIC") 18 including various control circuits. The controller 7 further includes a nonvolatile memory 19 configured to store various control parameters that can be rewritten. The controller 7 is connected to an external device 9, e.g., a personal computer ("PC"), and is configured to perform data communication with the external device 9. The controller 7 is further configured to control components of the printer 1, e.g., the inkjet heads 4 and a conveyor motor, based on image data transmitted from the external device 9.

More specifically, the controller 7 controls the conveyor motor to cause the conveyor rollers 5 and 6 to convey a recording sheet 100 along the conveyance direction. While controlling the sheet conveyance, the controller 7 controls the inkjet heads 4 to eject ink onto the recording sheet 100. Thus, an image is printed on the recording sheet 100.

The external device 9 may be, for example, a PC that includes a controller including ICs, such as a CPU, a RAM, and a ROM, and that has a printer driver corresponding to the printer 1 installed therein. In the illustrative embodiment, for example, a user provides an image printing instruction by operating the external device 9. In response to the image printing instruction through the user operation, the external device 9 transmits RGB image data 300 to the printer 1. The image data 300 is an example of original image data.

<Configuration of Inkjet Heads>

Figure 2A:
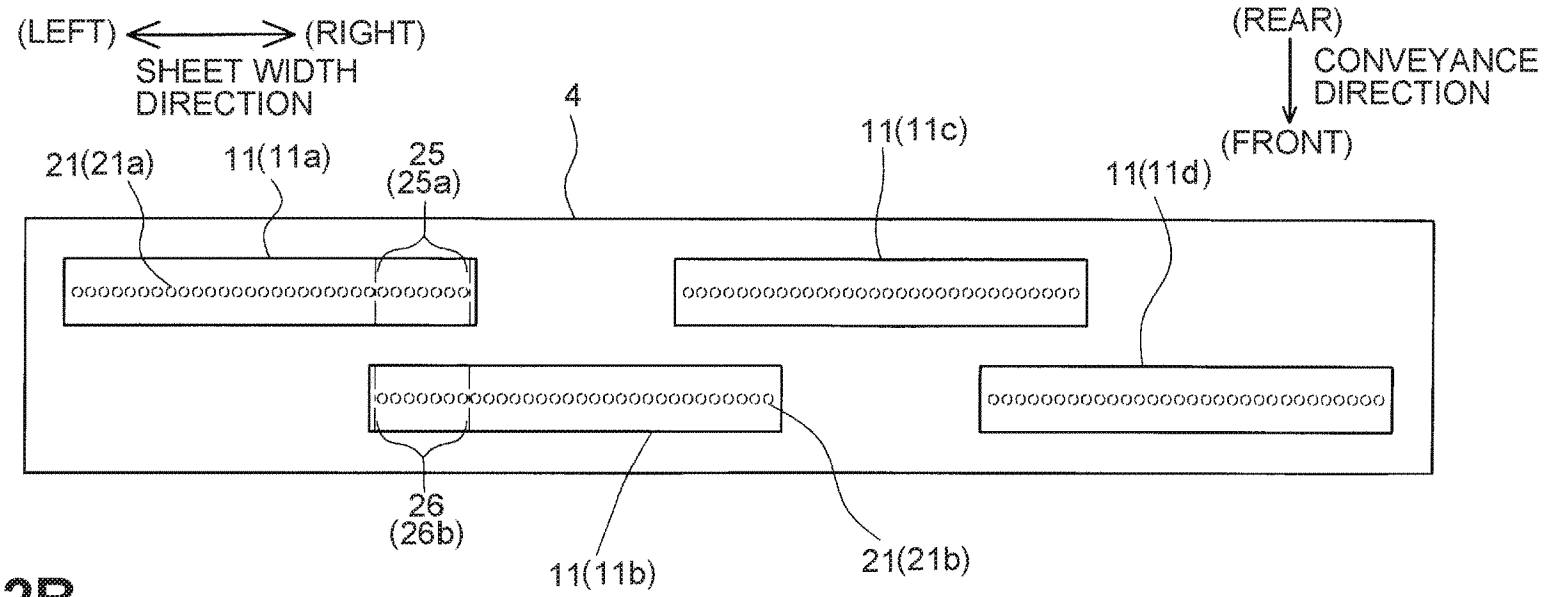
FIG. 2A is a plan view of one of inkjet heads in the illustrative embodiment according to one or more aspects of the disclosure.

Hereinafter, the inkjet heads 4 will be described in detail. All of the inkjet heads 4 have the same or similar configuration, and therefore, one of the inkjet heads 4 will be described in detail. As illustrated in FIG. 2A, the inkjet head 4 includes a plurality of, for example, four head units 11 that are positioned along the right-left direction.

The four head units 11 are alternately aligned in two rows (e.g., a front row and a rear row) with respect to the conveyance direction. That is, the head units 11 are staggered along the right-left direction. Each of the head units 11 has nozzles 21 arrayed along the right-left direction.

The head units 11 in the front row and the head units 11 in the rear row partially overlap when viewed in the front-rear direction. When distinguishing between the four head units 11, the head units 11 are referred to as head units 11*a*, 11*b*, 11*c*, and 11*d* individually from the left in the inkjet head 4. When not distinguishing between the four head units 11, the head units 11*a*, 11*b*, 11*c*, and 11*d* are collectively referred to as the head units 11. Similar to this, reference numerals for components corresponding to the respective head units 11*a*, 11*b*, 11*c*, and 11*d* also include appropriate one of letters "a", "b", "c", and "d", at the respective ends of the reference numerals when distinguishing between the components. Nevertheless, when not distinguishing therebetween, no distinguishing letter is appended thereto.

Hereinafter, an array pattern of the nozzles 21 included in each head unit 11 will be described. All of the head units 11 have the same or similar configuration, and therefore, one of the head units 11 will be described in detail. In the illustrative embodiment, for example, the head unit 11 has 100 nozzles 21. For explanatory convenience, as illustrated in FIGS. 2B and 3, numbers, e.g., #1, #2, . . . , and #100, are assigned to the nozzles 21 from the left.

Figure 2B:
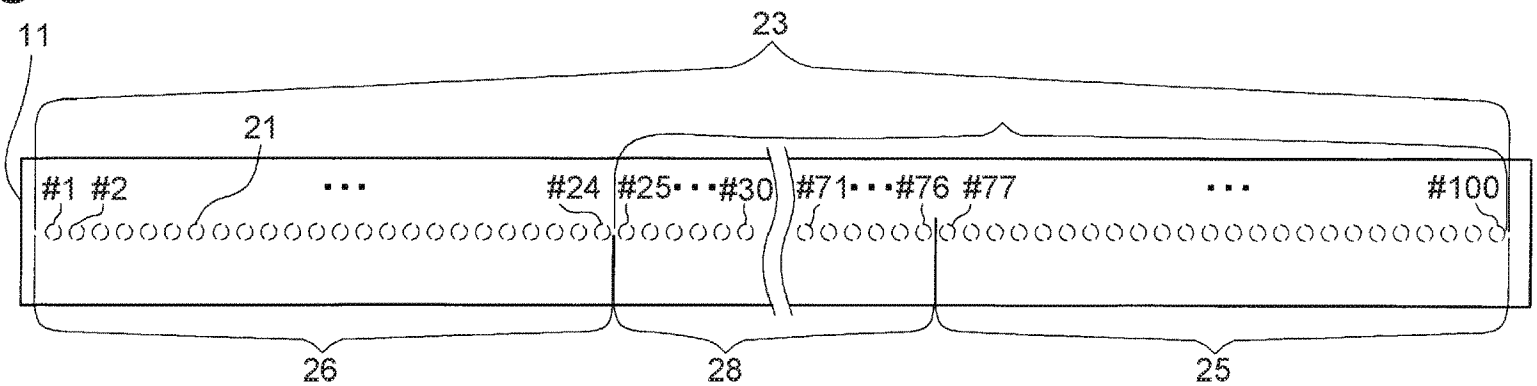
FIG. 2B is a plan view of one of head units in the illustrative embodiment according to one or more aspects of the disclosure.

As illustrated in FIG. 2B, the head unit 11 includes a nozzle group 23 consisting of one-hundred nozzles 21. The nozzle group 23 further includes nozzle groups 25, 26, and 28. The nozzle group 28 is positioned between the nozzle groups 25 and 26. The nozzle group 25 is positioned to the right of the nozzle group 28. The nozzle group 26 is positioned to the left of the nozzle group 28. The nozzle group 26 consists of twenty-four nozzles 21 of #1 to #24. The nozzle group 28 consists of fifty-two nozzles 21 of #25 to #76. The nozzle group 25 consists of twenty-four nozzles 21 of #77 to #100. The nozzle groups 25 and 28 are collectively referred to as a nozzle group 29.

Figure 3:
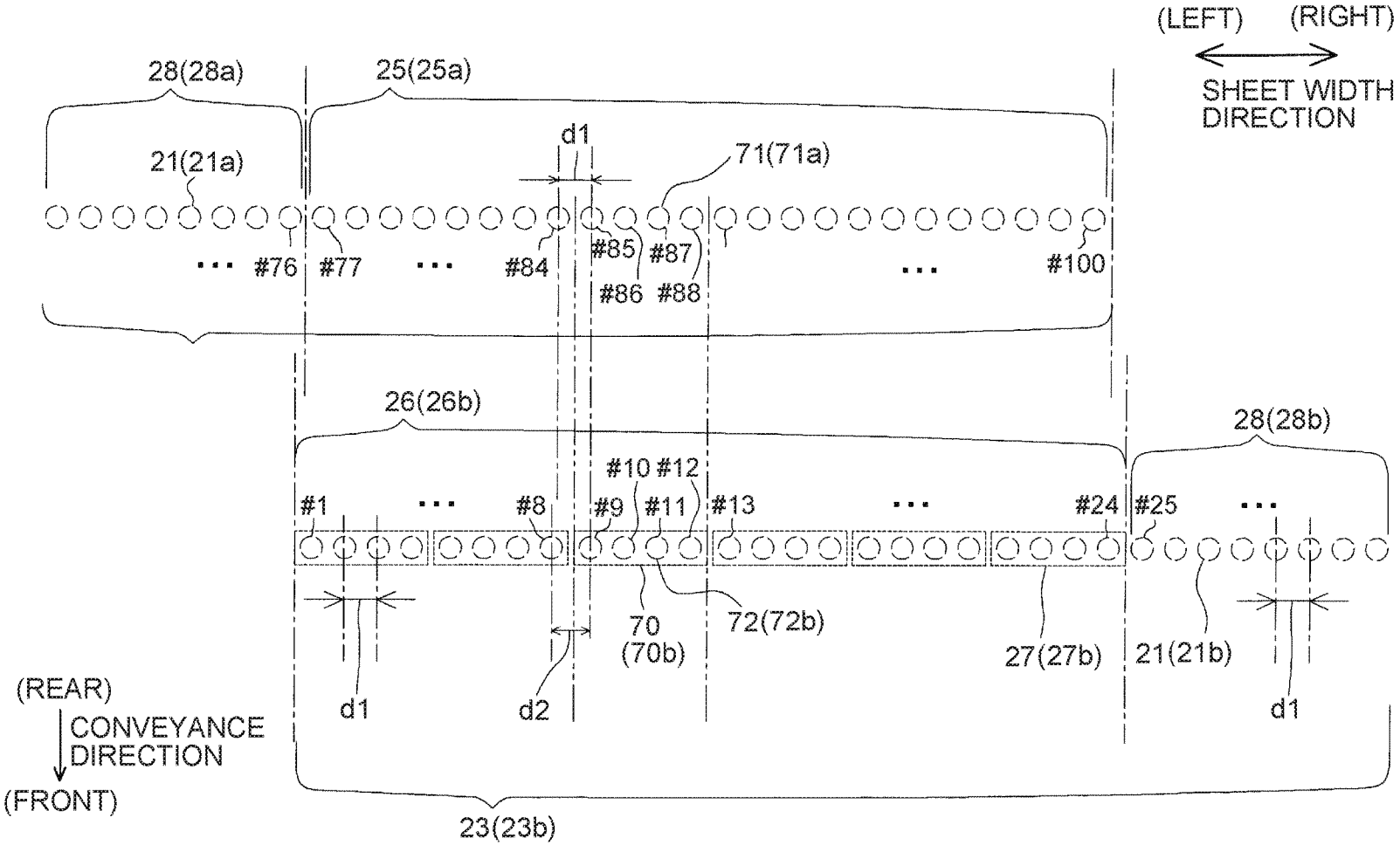
FIG. 3 is a partial enlarged plan view of two of the head units each including nozzle groups in the illustrative embodiment according to one or more aspects of the disclosure.

As illustrated in FIG. 3, the total of seventy-six nozzles 21 of #25 to #100 included in one or the other of the nozzle groups 28 and 25 are arrayed along the right-left direction with a pitch d1. The twenty-four nozzles 21 of #1 to #24 included in the nozzle group 26 are arrayed with distinctive pitches.

More specifically, for example, the nozzle group 26 consists of six nozzle sets 27, each of which consists of four of the nozzles 21. In each nozzle set 27, the four nozzles 21 are spaced from each other at the pitch d1. The endmost nozzles 21 that are included in respective adjacent nozzle sets 27 and adjacent to each other are spaced from each other at a pitch d2 that is greater than the pitch d1.

That is, the nozzle group 26 includes five pairs of the adjacent nozzles 21 spaced from each other at the pitch d2: a pair of the nozzles 21 of #4 and #5, a pair of the nozzles 21 of #8 and #9, a pair of the nozzles 21 of #12 and #13, a pair of the nozzles 21 of #16 and #17, and a pair of the nozzles 21 of #20 and #21. In a pair of the adjacent nozzles 21 of #24 and #25, the nozzles 21 are spaced from each other at the pitch d1. The head units 11*a*, 11*b*, 11*c*, and 11*d* each have a plurality of nozzles 21 arrayed in the above-described pattern.

A relatively large difference between the pitch d1 and the pitch d2 may be visible to human eyes. Therefore, it is preferable that the difference be a predetermined amount or smaller. For example, the difference between the pitch d2 and the pitch d1 may be one-quarter of the pitch d1 or smaller. In a case where a single inkjet head is capable of printing at a resolution of 600 dpi, the pitch d1 is 42 μm. In this case, the difference between the pitch d2 and the pitch d1 may preferably be 10 μm or smaller.

FIG. 3 illustrates an array pattern of nozzles 21*a* in the head unit 11*a* in the rear row and an array pattern of nozzles 21*b* in the head unit 11*b* in the front row at the overlap area where the head units 11*a* and 11*b* overlap each other when viewed in the front-rear direction. The head unit 11*a* has the nozzle group 25*a* at its right end portion, and the head unit 11*b* has the nozzle group 26*b* at its left end portion. The head unit 11*a* and the head unit 11*b* are disposed such that the nozzle group 25*a* of the head unit 11*a* and the nozzle group 26*b* of the head unit 11*b* are positioned at substantially the same relative positions in the right-left direction. In other words, the nozzle group 25*a* of the head unit 11*a* is positioned next to the nozzle group 26*b* of the head unit 11*b* in the front-rear direction.

In a case where a single inkjet head is capable of printing at a resolution of 600 dpi, the pitch d1 is 42 μm. In this case, the difference between the pitch d2 and the pitch d1 may preferably be 10 μm or smaller.

For example, in a case where the pitch d1 is 42 μm and the pitch d2 is 50.4 μm, the difference between the pitch d2 and the pitch d1 is 8.4 μm. In this case, the nozzles 21*b* included in each nozzle set 27*b* are offset every nozzle set 27 by 8.4 μm in the right-left direction with respect to their corresponding nozzles 21*a*.

Therefore, while a distance between the nozzles 21*a* of #77 and #100 in the nozzle group 25*a* of the head unit 11*a* is 966 μm, a distance between the nozzles 21*b* of #1 and #24 in the nozzle group 26*b* is 1008 μm. That is, a distance difference therebetween is 42 μm. This distance difference corresponds to the pitch d1.

As described above, the distances between the nozzles 21*b* and their corresponding nozzles 21*a* in the right-left direction are different between the nozzle sets 27. Therefore, the nozzle group 26 includes a nozzle set 27*b* consisting of nozzles 21*b* that are offset minimum with respect to their corresponding nozzles 21*a*. Hereinafter, such a nozzle set 27*b* is referred to as an optimum nozzle set 70*b*.

In FIG. 3, the third nozzle set 27*b* from the left located between double-dotted-and-dashed lines corresponds to the optimum nozzle set 70*b*. Four nozzles 21*b* (e.g., the nozzles 21*b* of #9 to #12) constituting the optimum nozzle set 70*b* are substantially aligned with their respective corresponding nozzles 21*a* (e.g., the nozzles 21*a* of #85 to #88) in the front-rear direction. Hereinafter, the four nozzles 21*b* constituting the optimum nozzle set 70*b* are referred to as optimum nozzles 72*b*, and the four nozzles 21*a* corresponding to the respective optimum nozzles 72*b* are referred to as optimum nozzles 716*a*.

Similarly to the head unit 11*a*, the head unit 11*b* includes a nozzle group 23*b*, and the nozzle group 23*b* includes a nozzle group 25*b* at the right end portion thereof. The head units 11*c* and 11*d* also each have nozzles 21 that are arrayed in a similar manner to the nozzles 21*b* of the head unit 11*b*. Therefore, the head units 11*c* and 11*d* also include optimum nozzle sets 70*c* and 70*d*, respectively. The optimum nozzle sets 70*b*, 70*c*, and 70*d* are also collectively referred to as optimum nozzle sets 70. The nonvolatile memory 19 stores optimum position information in association with each of the head units 11*b*, 11*c*, and 11*d*. The optimum position information represents the position of the nozzle set 27 that corresponds to the optimum nozzle set 70 in the head unit 11 in a sequence from the left. The nonvolatile memory 19 stores three pieces of optimum position information for each inkjet head 4, and thus, the nonvolatile memory 19 stores a total of 12 pieces of optimum position information therein.

<Ejection Control for Head Units>

Hereinafter, an ejection control for the nozzle group 25*a* of the head unit 11*a* and the nozzle group 26*b* of the head unit 11*b* will be described.

The controller 7 changes nozzles 21 to be used for printing between the nozzles 21*a* and the nozzles 21*b* at a boundary region corresponding to the optimum nozzle set 70*b*. That is, the controller 7 causes both the head units 11*a* and 11*b* to eject ink from their optimum nozzles 71*a* and 71*b*, respectively, at the boundary region. Nevertheless, the controller 7 causes only the head unit 11*a* to eject ink from appropriate nozzles 21*a* on the left with respect to the optimum nozzle set 70*b*, and causes only the head unit 11*b* to eject ink from appropriate nozzles 21b on the right with respect to the optimum nozzle set 70*b*.

In the boundary region corresponding to the optimum nozzle set 70*b*, the nozzles 21*b* are substantially aligned with their corresponding nozzles 21*a*, respectively, in the front-rear direction. Therefore, this configuration may minimize deviation of landing positions of ink droplets ejected from each nozzle 21*b* and its corresponding nozzle 21*a* relative to each other. Thus, this configuration may effectively reduce density unevenness that may be caused by misalignment of the nozzles 21*a* of the head unit 11*a* and the nozzles 21*b* of the head unit 11*b*.

Figure 4:
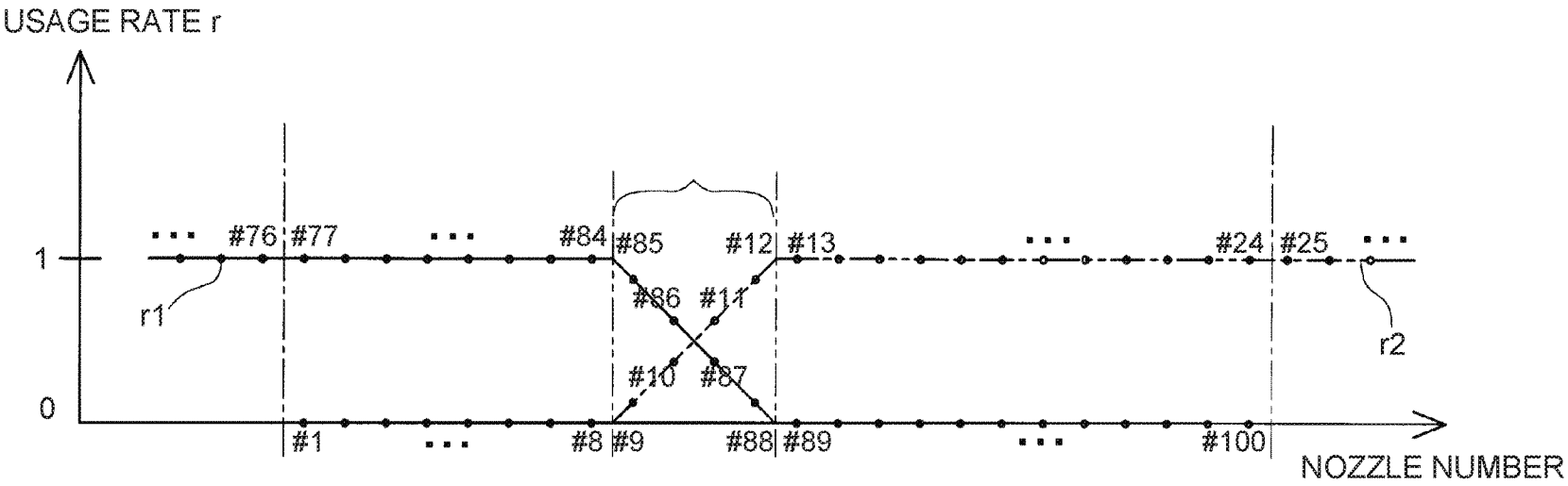
FIG. 4 is a graph showing nozzle usage rates in the two head units in the illustrative embodiment according to one or more aspects of the disclosure.

FIG. 4 illustrates a graph showing a usage rate r1 of each nozzle 21*a* included in the nozzle group 25*a* or in its adjacent group, and a usage rate r2 of each nozzle 21*b* included in the nozzle group 26*b* or in its adjacent group. In the graph, a horizontal axis indicates the nozzle number of each nozzle 21 and a vertical axis indicates a usage rate r of each nozzle 21. The usage rate r is determined based on mask data.

A solid line represents a usage rate r1 of each nozzle 21*a*, and a double-dotted-and-dashed line represents a usage rate r2 of each nozzle 21*b*. The graph shows both the usage rate r1 of each nozzle 21*a* included in the nozzle group 25*a* and the usage rate r2 of each nozzle 21*b* included in the nozzle group 26*b* within a range specified by two dotted-and-dashed lines.

In the illustrative embodiment, both the optimum nozzles 71*a* of the head unit 11*a* and the optimum nozzles 72*b* of the head unit 11*b* are used to eject ink. More specifically, for example, as illustrated in FIG. 4, lines representing the respective usage rates r1 and r2 change linearly within a range corresponding to the optimum nozzle set 70*b*. That is, the line representing the usage rates r1 of the nozzles 21*a* declines linearly from the nozzle 21 of #85 to the nozzle 21 of #88, whereas the line representing the usage rates r2 of the nozzles 21*b* rises linearly from the nozzle 21 of #9 to the nozzle 21 of #12. For example, the usage rate r1 of the nozzle 21*a* of #87 is 0.4, and the usage rate r2 of the nozzle 21*b* of #11 corresponding to the nozzle 21*a* of #87 is 0.6.

Assuming that an average of the usage rates r1 of the four optimum nozzles 71*a* is an average usage rate R1 and an average of the usage rates r2 of the four optimum nozzles 72*b* is an average usage rate R2, the average usage rate R1 satisfies $0<R1<1$ and the average usage rate R2 satisfies $0<R2<1$. More specifically, the average usage rate $R1=0.5$, and the average usage rate $R2=0.5$. In this case, an equal amount of ink is ejected from each of the optimum nozzles 71*a* and the optimum nozzles 72*b*

As described above, the optimum nozzles 72*b* are substantially aligned with their corresponding optimum nozzles 71*a*, respectively, in the front-rear direction. Therefore, this configuration may minimize deviation of landing positions of ink droplets that may be caused by misalignment of the nozzles 21*b* and 21*a*. Nevertheless, if landing positions of ink droplets ejected from each nozzle 21*b* and its corresponding nozzle 21*a* are deviated relative to each other due to another factor, e.g., defective conveyance, this positional deviation may influence a printed image directly.

In the illustrative embodiment, ink is ejected from each of the optimum nozzles 71*a* and 72*b*. Thus, ink droplets ejected from each of the head units 11*a* and 11*b* land on a recording sheet 100 dispersedly. Accordingly, if the landing positions of ink droplets ejected from each nozzle 21*b* and its corresponding nozzle 21*a* are deviated relative to each other due to another factor, density unevenness may be inconspicuous.

<Controller Operation>

Hereinafter, referring to FIGS. 5 and 6A to 6D, operation executed by the controller 7 of the printer 1 will be described.

Figure 5:
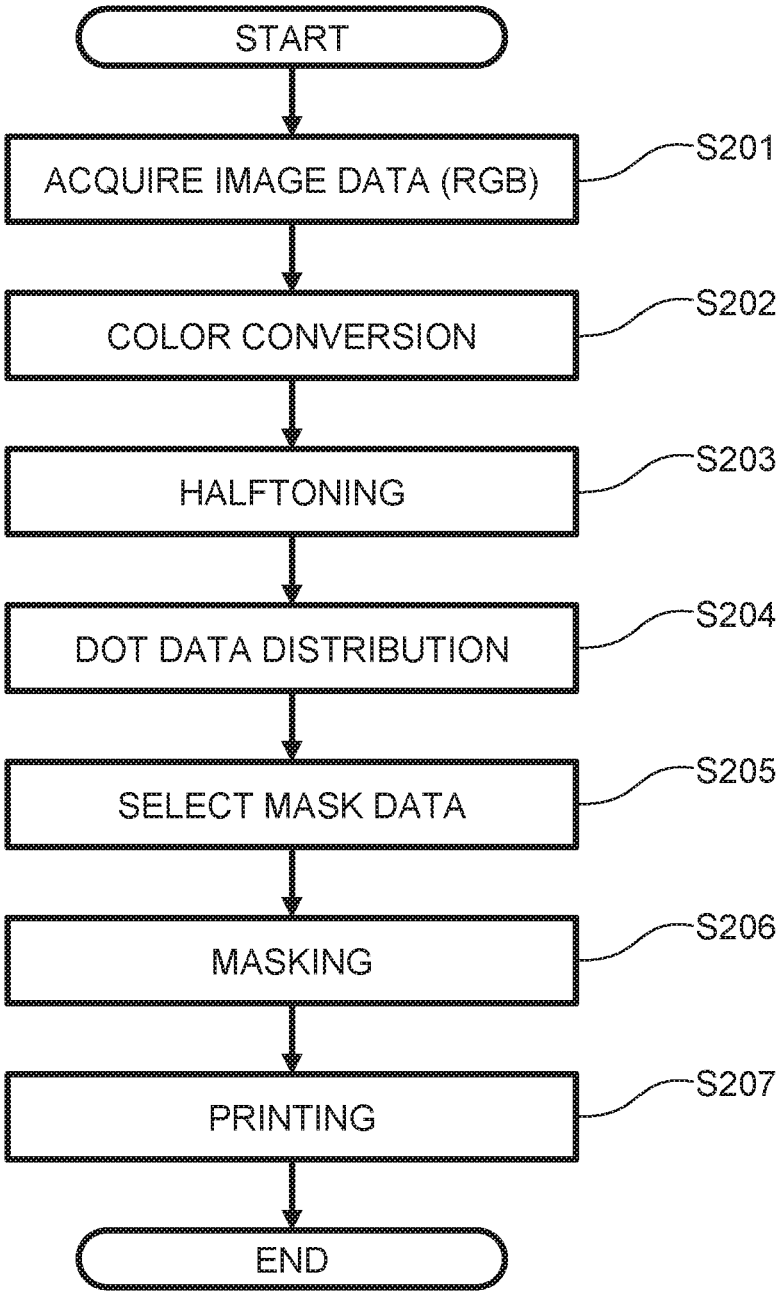
FIG. 5 is a flowchart of an example printing process in the illustrative embodiment according to one or more aspects of the disclosure.

As illustrated in FIG. 5, in response to an input of a print instruction to the printer 1 from the external device 9, the controller 7 acquires image data 300 from the external device 9 (e.g., step S201). The image data 300 includes image data 300R corresponding to red ("R"), image data 300G corresponding to green ("G"), and image data 300B corresponding to blue ("B"). Each image data 300R, 300G, and 300B consists of a plurality of pieces of pixel data that are equal in number to the number of pixels corresponding to the resolution of the printer 1. Each image data 300R, 300G, and 300B may be represented by 256 color levels and represent a color level value of a corresponding color. The image data 300 is generated based on an electronic file in a predetermined format by cooperation of an application program installed on the external device, a printer driver, and an operation system.

Subsequent to step S201, the controller 7 performs color conversion in which the image data 300 corresponding to RGB is converted into image data 400 corresponding to CMYK (e.g., ink colors) (e.g., step S202). The image data 400 includes image data 400K corresponding to black, image data 400Y corresponding to yellow, image data 400C corresponding to cyan, and image data 400M corresponding to magenta. Each image data 400K, 400Y, 400C, and 400M consists of a plurality of pieces of pixel data that are equal in number to the number of pixels corresponding to the resolution of the printer 1. Each image data 400K, 400Y, 400C, and 400M may be represented by 256 color levels and represent a color level value of a corresponding color. The image data may be converted from an RGB format to a CMYK format using a lookup table in which a relationship between mean values of color level values of RGB and color level values of CMYK is prestored.

The controller 7 performs halftoning on each of the K image data 400K, the Y image data 400Y, the C image data 400C, and the M image data 400M to generate dot data 40 correspondingly. Each dot data 40 corresponds to one of the ink colors of CMYK and represents the necessity or unnecessity of dot formation in each pixel. The dot data 40 may be image data consisting of a plurality of pieces of pixel data that are equal in number to the number of pixels corresponding to the resolution of the printer 1. The dot data 40 includes dot data 40K corresponding to black, dot data 40Y corresponding to yellow, dot data 40C corresponding to cyan, and dot data 40M corresponding to magenta. Each pixel data of the dot data 40K, 40Y, 40C, and 40M may be binary data representing the necessity or unnecessity of ink ejection from a corresponding nozzle 21. A known data conversion method, for example, an error diffusion method or dithering, is used for the data conversion executed in the halftoning.

Figure 6A:
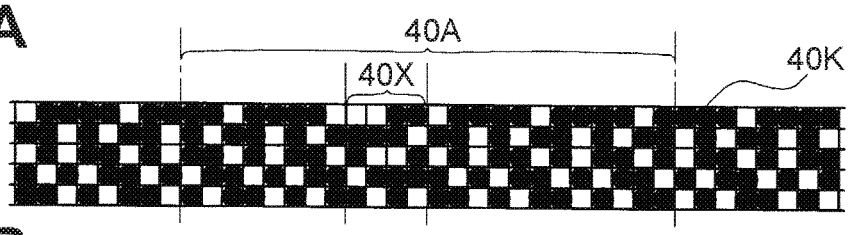
FIG. 6A illustrates dot data on which dot data distribution has not been executed in the illustrative embodiment according to one or more aspects of the disclosure.

FIG. 6A illustrates an example of black dot data 40K. FIG. 6A illustrates a portion of the black dot data 40K, and more specifically, illustrates 40 pieces of pixel data (in the right-left direction) by 5 lines (in the front-rear direction). In FIG. 6A, a blank or white cell schematically represents pixel data indicating the unnecessity of ink ejection from its corresponding nozzle. A cell with a black dot schematically represents pixel data indicating the necessity of ink ejection from its corresponding nozzle.

Subsequent to step S203, the controller 7 distributes the dot data 40K, the dot data 40Y, the dot data 40C, and the dot data 40M to the four head units 11, respectively, corresponding to the respective colors. This dot data distribution will be described using an example in which dot data 40K is distributed to the head units 11*a* and 11*b* of the black inkjet head 4. Hereinafter, although an explanation will be made on the black inkjet head 4 only, the dot data distribution is also performed on each of the other inkjet heads 4 in the same or similar manner.

As a first step, dot data 41K is generated by duplicating pixel data of the 1st row to the 100th row of the dot data 40K generated in step S203, from the left in the right-left direction. The pixel data included in each of the 1st to 100th rows of the dot data 41K corresponds to one of the nozzles 21*a* of #1 to #100 of the head unit 11*a*.

Then, dot data 42K is generated by duplicating pixel data of the 77th row to the 176th row of the dot data 40K generated in step S203, from the left in the right-left direction. The pixel data included in the 77th row to the 176th row of the dot data 42K corresponds to one of the nozzles 21*b* of #1 to #100 of the head unit 11*b*. Each of the dot data 41K and 42K is an example of intermediate image data.

In step S204, dot data 43K (not illustrated) and dot data 44K (not illustrated) are also generated. More specifically, for example, the dot data 43K is generated by duplicating pixel data of the 153th row to the 252th row of the dot data 40K from the left in the right-left direction. The dot data 44K is generated by duplicating pixel data of the 229th row to the 328th row of the dot data 40K from the left in the right-left direction.

Figure 6B:
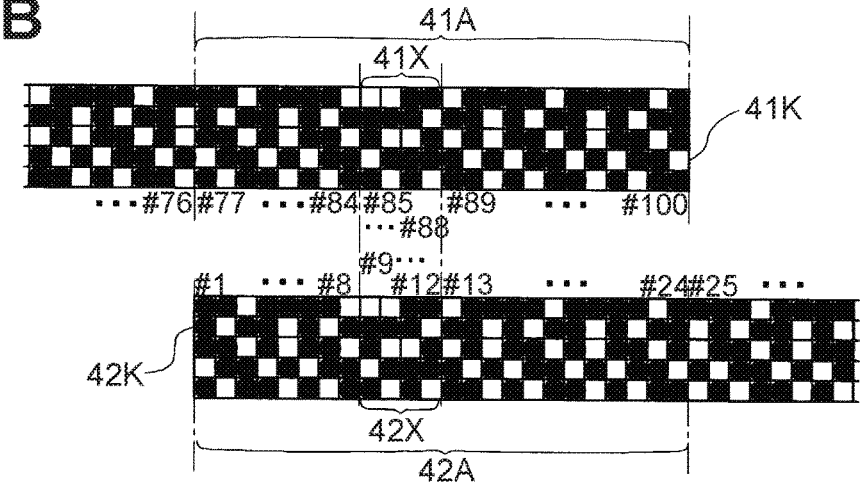
FIG. 6B illustrates dot data on which the dot data distribution has been executed in the illustrative embodiment according to one or more aspects of the disclosure.

FIG. 6B schematically illustrates the dot data 41K for the head unit 11*a* and the dot data 42K for the head unit 11*b*. Similarly to the dot data 40K, a cell with a black dot schematically represents pixel data indicating the necessity of ink ejection from its corresponding nozzle. A blank or white cell schematically represents pixel data indicating the unnecessity of ink ejection from its corresponding nozzle.

As illustrated in FIG. 6A, in the dot data 40K which has not been distributed to the head units 11*a* and 11*b*, partial data consisting of a plurality of pieces of pixel data included in a particular region corresponding to both the nozzles 21*a* of the nozzle group 25*a* and the nozzles 21*b* of the nozzle group 25*b*, is referred to as dot data 40A. In the dot data 41K which has been distributed to the head unit 11*a*, partial data consisting of a plurality of pieces of pixel data included in a particular region corresponding to the nozzles 21*a* of the nozzle group 25*a* is referred to as dot data 41A. In the dot data 42K which has been distributed to the head unit 11*b*, partial data consisting of a plurality of pieces of pixel data included in a particular region corresponding to the nozzles 21*b* of the nozzle group 26*b* is referred to as dot data 42A. In the undistributed dot data 40K, partial data consisting of a plurality of pieces of pixel data included in another particular region corresponding to both of the optimum nozzles 71*a* nd the optimum nozzles 72*b* is referred to as dot data 40X. In the distributed dot data 41K, partial data consisting of a plurality of pieces of pixel data included in another particular region corresponding to the optimum nozzles 71*a* is referred to as dot data 41X. In the distributed dot data 42K, partial data consisting of a plurality of pieces of pixel data included in another particular region corresponding the optimum nozzles 72*b* is referred to as dot data 42X.

At the distribution, the nozzles 21*a* of the nozzle group 25*a* are assigned with the dot data 41A, and the nozzles 21*b* of the nozzle group 25*b* are assigned with the dot data 42A. Nevertheless, the dot data 41A and 42A of the distributed dot data 41K and 42K, respectively, are identical to the dot data 40A of the undistributed dot data 40K.

Subsequent to step S204, the controller 7 selects mask data for applying masking to each of the dot data 41K, 42K, 43K, and 44K (e.g., step S205).

As described above, the nonvolatile memory 19 of the controller 7 stores 12 pieces of the optimum position information. The nonvolatile memory 19 stores six varieties of mask data each corresponding to the nozzles 21 of #51 to #100 that include the nozzles 21 constituting the nozzle group 25 and another six varieties of mask data each corresponding to the nozzles 21 of #1 to #50 that include the nozzles 21 constituting the nozzle group 26, in association with each of the six different optimum positions. That is, a total of 12 varieties of mask data is prepared. Referring to the optimum position information corresponding to each head unit 11 stored in the nonvolatile memory 19, the controller 7 reads each appropriate mask data for applying masking to a corresponding one of the dot data 41K, 42K, 43K, and 44K. The controller 7 combines the mask data corresponding to the nozzles 21 of #1 to #50 and the mask data corresponding to the nozzles 21 of #51 to #100 with each other, and stores the combined mask data for each head unit 11 in the RAM 17.

Figure 6C:
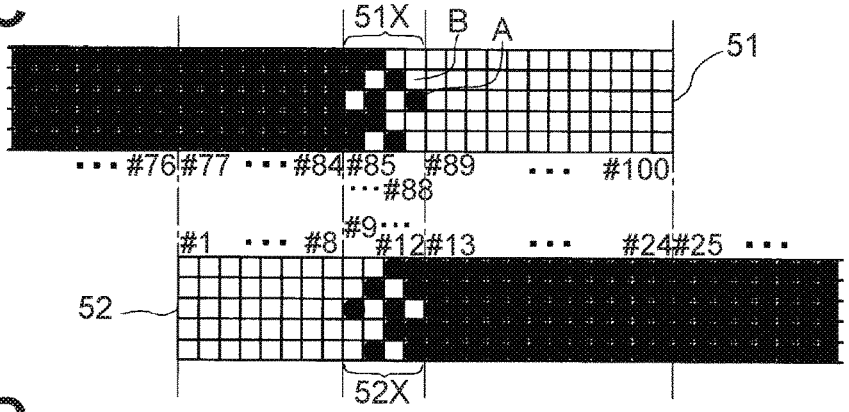
FIG. 6C illustrates mask data to be used in masking in the illustrative embodiment according to one or more aspects of the disclosure.

FIG. 6C illustrates mask data 51 corresponding to the head unit 11*a* and mask data 52 corresponding to the head unit 11*b* of the black inkjet head 4. The mask data 51 and 52 include regions 51X and 52X, respectively, both corresponding to the position of the optimum nozzle set 70*b*. Each of the regions 51X and 52X includes both a data piece A and a data piece B. The data piece A represents the allowance of ink ejection. The data piece B represents the disallowance of ink ejection. In FIG. 6C, the data piece A is represented by a cell with a black dot, and the data piece B is represented by a blank or white cell. The controller 7 also reads mask data 53 (not illustrated) corresponding to the head unit 11*c* and mask data 54 (not illustrated) corresponding to the head unit 11*d*.

The nozzle usage rate r refers to a percentage of data pieces A included in a single data-piece row corresponding to a certain nozzle 21. For example, the single data-piece row includes five data pieces arrayed in the front-rear direction. In FIG. 6C, for example, a data-piece row corresponding to the nozzle 21 of #9 consists of one data piece A and four data pieces B. Therefore, a percentage of the data pieces A to the data-piece row is 0.2.

The percentage of the data pieces A included in the region 51X is referred to as an average usage rate R1 of the optimum nozzles 71*a*, and the percentage of the data pieces A included in the region 52X is referred to as an average usage rate R2 of the optimum nozzles 72*b*. In the example of FIG. 6C, the region 51X has a total of 20 data pieces including 10 data pieces A. Therefore, the average usage ratio R1 is 0.5. The average usage ratio R2 is also 0.5.

The six varieties of mask data include respective different regions in which the usage rate r is less than 1 (one). That is, in each mask data 51 and 52 according to the illustrative embodiment, the usage rate r is less than 1 (one) in the region corresponding to the third nozzle set 27*b* from the left. Nevertheless, in a case another nozzle set 27*b* corresponds to the optimum nozzle set 70*b*, other mask data is read.

Subsequent to step S205, the controller 7 executes masking on each dot data 41K, 42K, 43K, and 44K to generate ejection data 61K corresponding to the head unit 11*a*, ejection data 62K corresponding to the head unit 11*b*, ejection data 63K corresponding to the head unit 11*c*, and ejection data 64K corresponding to the head unit 11*d* (e.g., step S206).

Figure 6D:
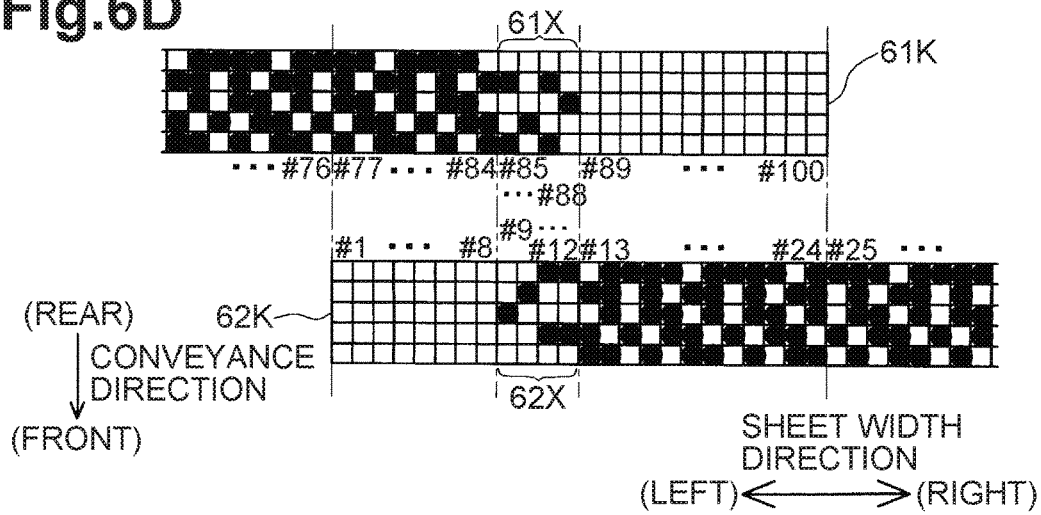
FIG. 6D illustrates ejection data generated through the masking in the illustrative embodiment according to one or more aspects of the disclosure.

FIG. 6D illustrates the ejection data 61K corresponding to the head unit 11*a* and the ejection data 62K corresponding to the head unit 11*b* of the black inkjet head 4. Similar to the dot data 40, each of the ejection data 61K and 62K may be binary data representing the necessity or unnecessity of ink ejection from a corresponding nozzle 21. The controller 7 also generates the ejection data 63K (not illustrated) corresponding to the head unit 11*c* and the ejection data 64K (not illustrated) corresponding to the head unit 11*d*.

The number of dots in each ejection data 61X and 62X corresponding to the position of the optimum nozzle set 70B is half of the number of dots in each unmasked dot data 41X and 42X. Each of the ejection data 61K, 62K, 63K, and 64K stored in the RAM 17 is transmitted to the black inkjet head 4. The same or similar processes are also performed on the data for each of the other inkjet heads 4. Then, the controller 7 executes printing by controlling the four inkjet heads 4 to eject ink therefrom (e.g., step S207).

<Boundary Region Determination in Each Nozzle Group>

Hereinafter, referring to FIGS. 7 to 9, an example procedure for determining a boundary region in each nozzle group 26 will be described in detail. The nozzles 21 to be used for printing are changed with respect to the determined boundary region. The boundary region determination is performed prior to shipping of the printer 1.

Figure 7:
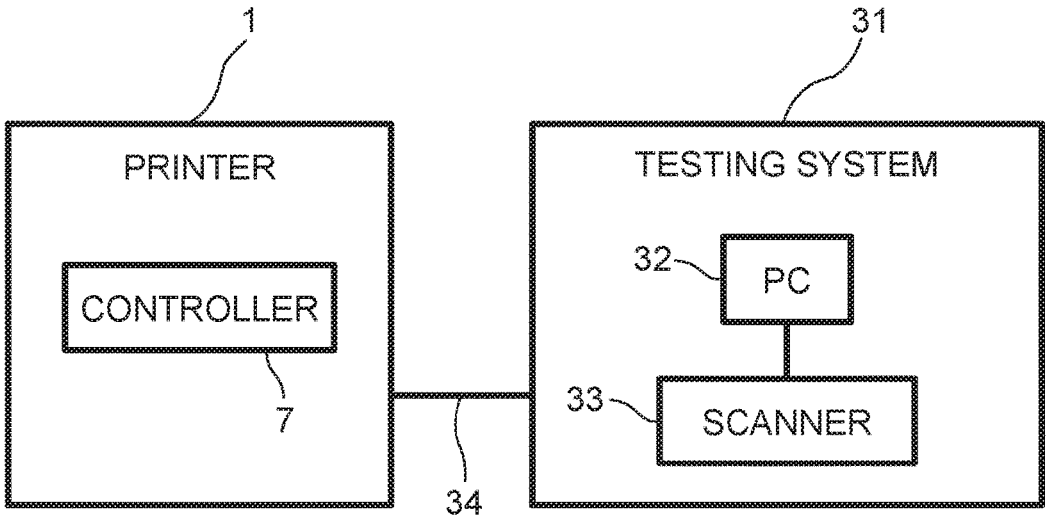
FIG. 7 is a block diagram of the printer and a testing system in the illustrative embodiment according to one or more aspects of the disclosure.

FIG. 7 is a block diagram of the printer 1 and a testing system 31. The testing system 31 is used for determining a boundary region in each nozzle group 26*b*. The testing system 31 includes a PC 32 and a scanner 33 connected to the PC 32. The printer 1 and the testing system 31 is connected to each other via a cable 34 and are capable of communicating with each other.

Figure 8:
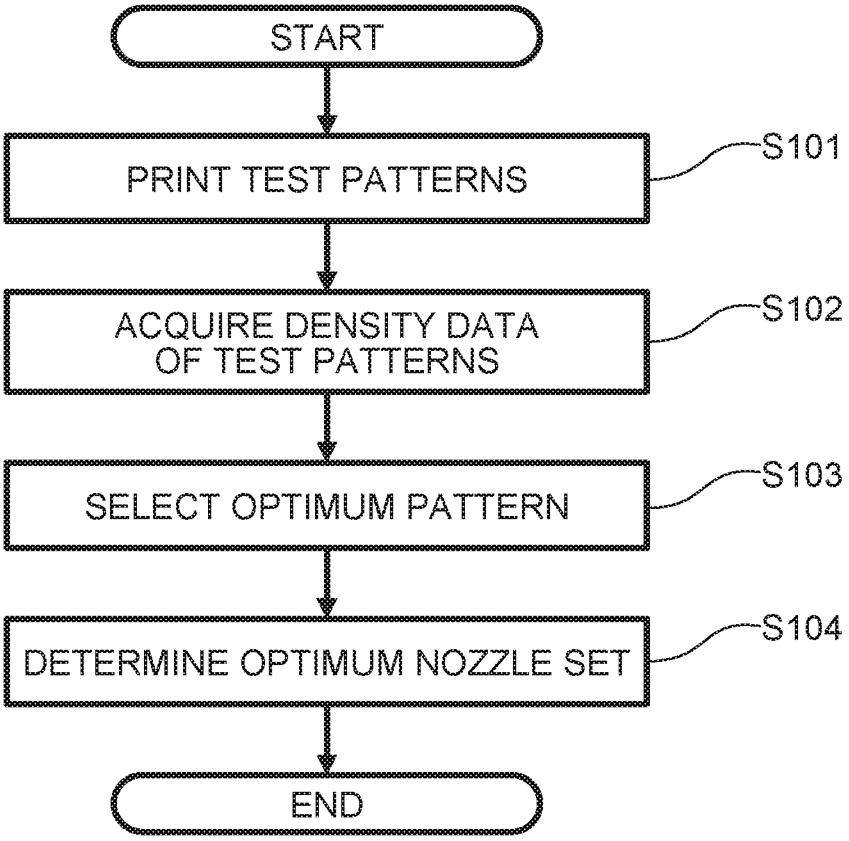
FIG. 8 is a flowchart illustrating a procedure for selecting nozzles to be used for printing in the illustrative embodiment according to one or more aspects of the disclosure.

FIG. 8 is a flowchart of an example boundary region determining process. As illustrated in FIG. 8, the testing system 31 causes the printer 1 to print test patterns on a recording sheet 100 (e.g., step S101). The test patterns are used for determining an optimum nozzle set 70 among the six nozzle sets 27 in each nozzle group 26.

Figure 9A:
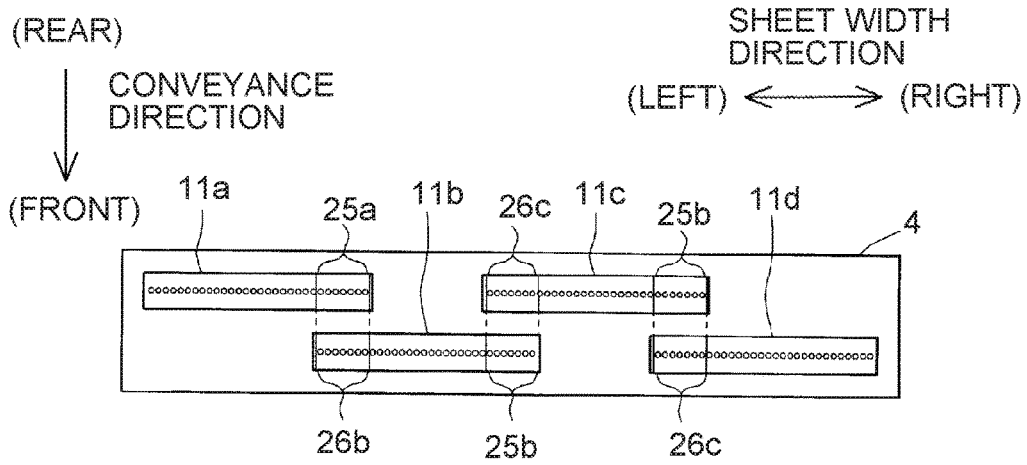
FIG. 9A is a plan view of one of the inkjet heads in the illustrative embodiment according to one or more aspects of the disclosure.
Figure 9B:
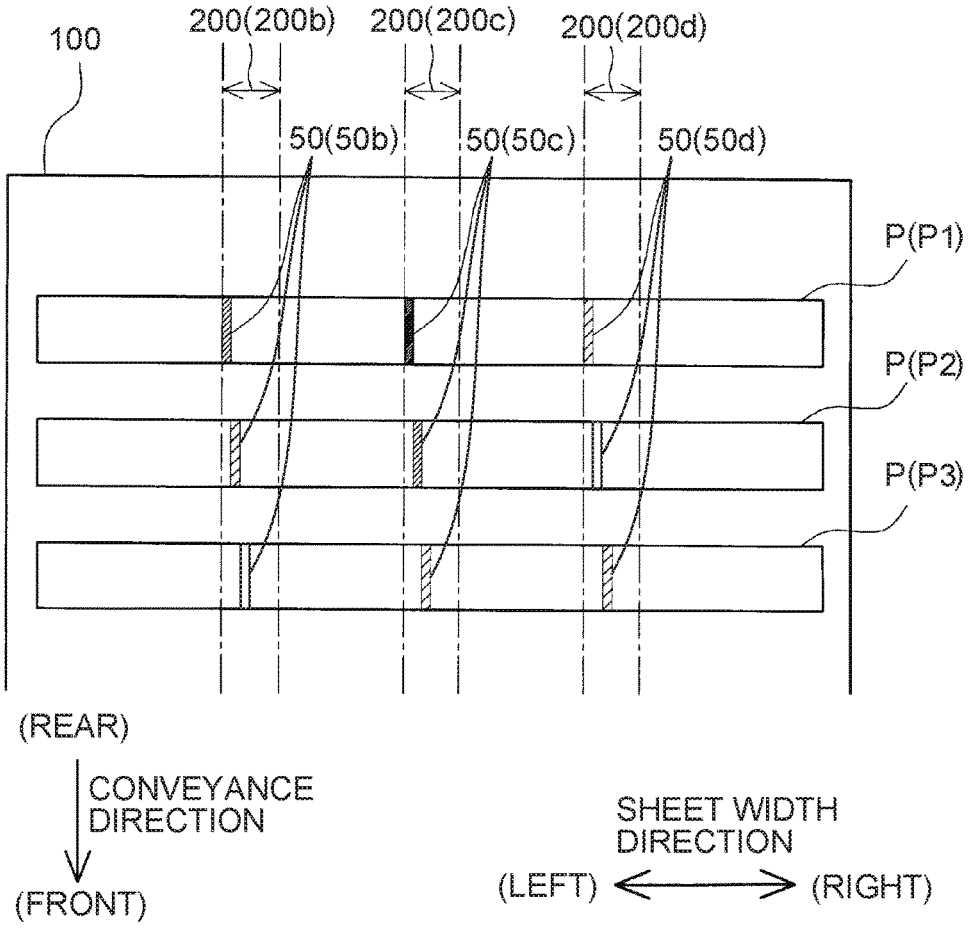
FIG. 9B illustrates test patterns printed on a recording sheet in the illustrative embodiment according to one or more aspects of the disclosure.

FIGS. 9A and 9B are explanatory diagrams for explaining an example test pattern printing process. The PC 32 of the testing system 31 inputs a print instruction to the printer 1 to cause the printer 1 to print six test patterns P on a recording sheet 100. The six test patterns P includes test pattaerns P1, P2, P3, P4, P5 and P6. FIG. 9B shows only three test pattaerns P1, P2 and P3. In the illustrative embodiment, the printer 1 includes four inkjet heads 4. Therefore, as illustrated in FIGS. 9A and 9B, a boundary region is determined in each nozzle group 26 of each inkjet head 4.

Hereinafter, an explanation will be made on the leftmost head unit 11*a* and the head unit 11*b* that is the right closest to the head unit 11*a* in the right-left direction. In printing of each of the six test patterns P, a different nozzle set 27*b* in the nozzle group 26*b* functions as a boundary region at which the nozzles 21 used for printing are changed from the nozzles 21*a* to the nozzles 21*b*. For example, during printing of a test pattern P1, the nozzles 21 used for printing is changed from the nozzles 21*a* to the nozzles 21*b* with respect to the leftmost nozzle set 27*b* among the six nozzle sets 27*b*. Under the circumstances where the boundary region is tentatively determined as such, the above-described ejection control is executed on the nozzle group 26*b*.

An area in the right-left direction occupied by an image formed on a recording sheet 100 by ink ejected from both of the nozzles 21*a* of the nozzle group 25*a* of the head unit 11*a* and the nozzles 21*b* of the nozzle group 26*b* of the head unit 11*b* while the test pattern P1 is printed, is referred to as a range 200*b*.

Similarly, another area in the right-left direction occupied by another image formed on the recording sheet 100 by ink ejected from the nozzles 21 of both the head unit 11*b* and the head unit 11*c* while the test pattern P1 is printed, is referred to as a range 200*c*. Still another area in the right-left direction occupied by still another image formed on the recording sheet 100 by ink ejected from the nozzles 21 of both the head unit 11*c* and the head unit 11*d* while the test pattern P1 is printed, is referred to as a range 200*d*. Hereinafter, an explanation will be made on the leftmost range 200*b*. The ranges 200*b*, 200*c*, and 200*d* are also collectively referred to as ranges 200 as needed.

In a case where the nozzle set 27*b* that is tentatively determined as the boundary region corresponds to the optimum nozzle set 70*b* in the nozzle group 26*b*, less density unevenness may occur in the image formed by ink ejected from both of the nozzles 21*b* of the nozzle group 26*b* and the nozzles 21*a* corresponding to the nozzles 21*b*. On the other hand, in a case where the nozzle set 27*b* that is tentatively determined as the boundary region does not correspond to the optimum nozzle set 70*b*, the landing positions of ink droplets ejected from the nozzles 21*a* and 21*b* may be deviated relative to each other at the position where the nozzles 21 used for printing are changed from the nozzles 21*a* to the nozzles 21*b*. Therefore, as illustrated in FIG. 9B, density unevenness 50*b* may occur within the range 200*b* on the recording sheet 100.

That is, occurrence or state of density unevenness 50*b* within the range 200*b* of the recording sheet 100 is acquired from each of the six test patterns P. Based on this acquisition, the test pattern P in which the nozzle change has been performed with respect to the optimum nozzle set 70*b* can be recognized. The same or similar determination is also made on the ranges 200*c* and 200*d*.

A single inkjet head 4 includes the nozzle group 26*b*, the nozzle group 26*c* and the nozzle group 26*d*. Assembly precision of two adjacent head units 11 affects the position of the optimum nozzle set 70. Therefore, between the nozzle group 26*b*, the nozzle group 26*c* and the nozzle group 26, different nozzle sets 27 may correspond to the optimum nozzle set 70. Accordingly, even when a particular test pattern P indicates the optimum nozzle set 70*b* for the nozzle group 26*b*, the same test pattern P might not always indicate the optimum nozzle sets 70*b* for the other nozzle groups 26*c* and 26*d*. That is, different test patterns P may indicate the optimum nozzle sets 70 for the respective nozzle groups 26.

Subsequent to step S101, the testing system 31 reads all the six test patterns P using the scanner 33 to acquire density data of an image corresponding to each of the ranges 200 of the recording sheet 100 in each test pattern P (e.g., step S102). The density data is acquired as a luminance value. A higher density portion in a test pattern P has lower luminance.

Subsequent to step S102, the testing system 31 selects, based on the acquired density data, each test pattern P having the smallest degree of density unevenness 50, as an optimum pattern, for a corresponding one of the ranges 200 of the recording sheet 100 (e.g., step S103). More specifically, the density data acquired using the scanner 33 is transmitted to the PC 32, and the PC 32 selects the optimum pattern by referring to the density data. For example, as illustrated in FIG. 9B, the test pattern P3 has the smallest degree of density unevenness 50*b* within the range 200*b*.

In the illustrative embodiment, the nozzles 21 used for printing are changed from the nozzles 21*a* to the nozzles 21*b* with respect to a nozzle set 27*b* consisting of four nozzles 21*b* arrayed with the pitch d1. Therefore, in a case where the nozzles 21 used for printing are changed with respect a nozzle set 27*b* corresponding to the optimum nozzle set 70*b*, ink droplets ejected from the nozzles 21*b* land on substantially the respective same positions as ink droplets ejected from the nozzles 21*a* within the range corresponding to the width of the nozzle set 27*b*. As opposed to this, in a case where the nozzles 21 used for printing are changed with respect to another nozzle set 27*b* not corresponding to the optimum nozzle set 70*b*, ink droplets ejected from the nozzles 21*b* land on respective different positions from ink droplets ejected from the nozzles 21*a* in the range corresponding to the width of the nozzle set 27*b*. That is, a portion in which density unevenness has occurred has a width equal to a width of a single nozzle set 27*b*, and therefore, the density unevenness may be recognized easily. Thus, the test pattern P in which the image has been formed by the nozzles 21*a* and the nozzles 21*b* that are aligned most precisely with each other may be found easily, and this may cause less misdetermination of such a test pattern P. Even if misdirection of ink ejection occurs in one or more of the nozzles 21*a* or one or more of the nozzles 21*b* included in the nozzle set 27*b* that is tentatively determined as the boundary region, the nozzle set 27*b* still has normal nozzles 21*a* and 21*b*. Therefore, the optimum nozzle set 70*b* may be determined based on an image formed using the normal nozzles 21*a* and 21*b*.

Subsequent to step S103, the testing system 31 determines the nozzle set 27*b* with respect to which the nozzles change has been performed in the optimum test pattern P selected in step S103, that is, positional information on the optimum nozzle set 70*b*, as a boundary region for the nozzle group 26*b* of the head unit 11*b* (e.g., S104). More specifically, the positional information on the optimum nozzle set 70*b* is stored in the ROM 12 of the controller 7 or the nonvolatile memory 19.

As described above, the nozzle group 26*b* includes a plurality of locations at which the nozzles 21*a* are aligned with the nozzles 21*b*, respectively. Therefore, recognizability of the test pattern P may be increased. Consequently, this may facilitate selection of the test pattern P having the smallest degree of density unevenness, which enables to readily recognize the optimum nozzle set 70*b* with respect to which the nozzle change has been performed in the selected test pattern P.

In the illustrative embodiment, as illustrated in FIG. 9B, the six printed test patterns P are scanned by the scanner 33 and the optimum pattern is selected for each nozzle group 26 based on the acquired density data. Nevertheless, in other embodiments, for example, an operator may visually check the density unevenness 50 in each of the test patterns P to select the optimum pattern for each nozzle group 26.

Hereinafter, alternative embodiments in which various changes or modifications are applied to the illustrative embodiment will be described. An explanation will be given mainly for the elements different from the illustrative embodiment, and an explanation will be omitted for the common elements by assigning the same reference numerals thereto.

(1) In the illustrative embodiment, the pitch d2 between the nozzle sets 27*b* included in the nozzle group 26*b* is greater than the pitch d1 between the nozzles 21*a* included in the nozzle group 25*a*. Nevertheless, in other embodiment, the pitch d2 may be smaller than the pitch d1.

Figure 10A:
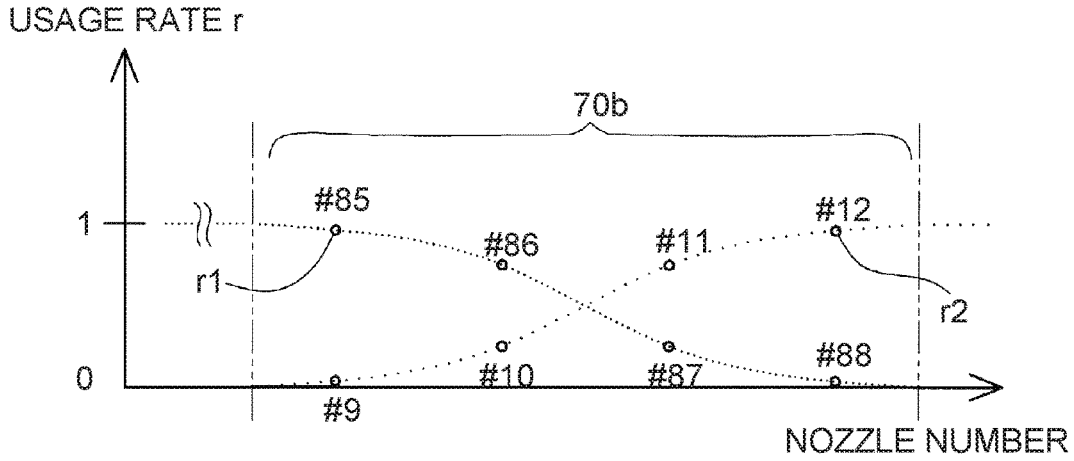
FIGS. 10A and 10B are graphs each showing nozzle usage rates in one alternative embodiment according to one or more aspects of the disclosure.
Figure 10B:
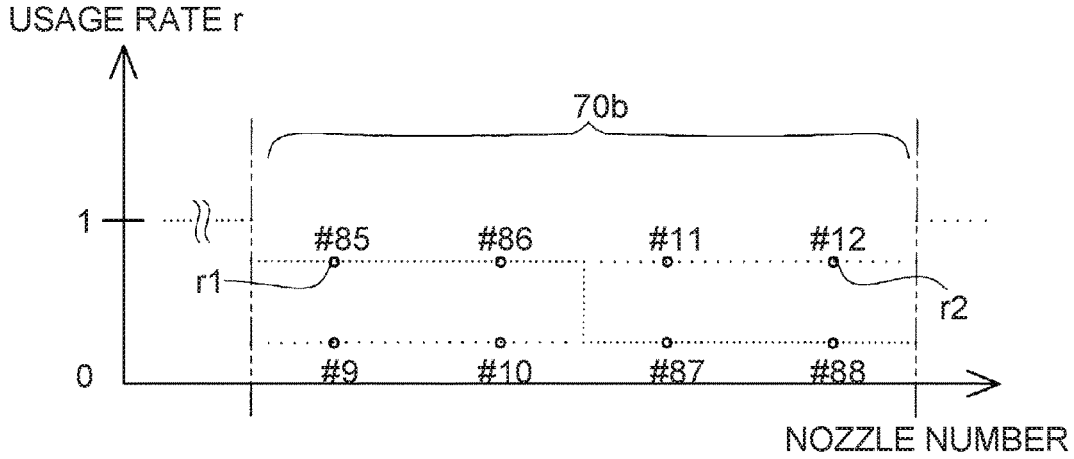

(2) The lines representing the nozzle usage rates r1 and r2 of the optimum nozzles 71*a* and 72*b* might not necessarily change linearly. In other embodiments, for example, as illustrated in FIG. 10A, the lines representing the nozzle usage rates r1 and r2 may change curvedly. In still other embodiments, for example, as illustrated in FIG. 10B, the lines representing the nozzle usage rates r1 and r2 may change step by step.

Figure 11:
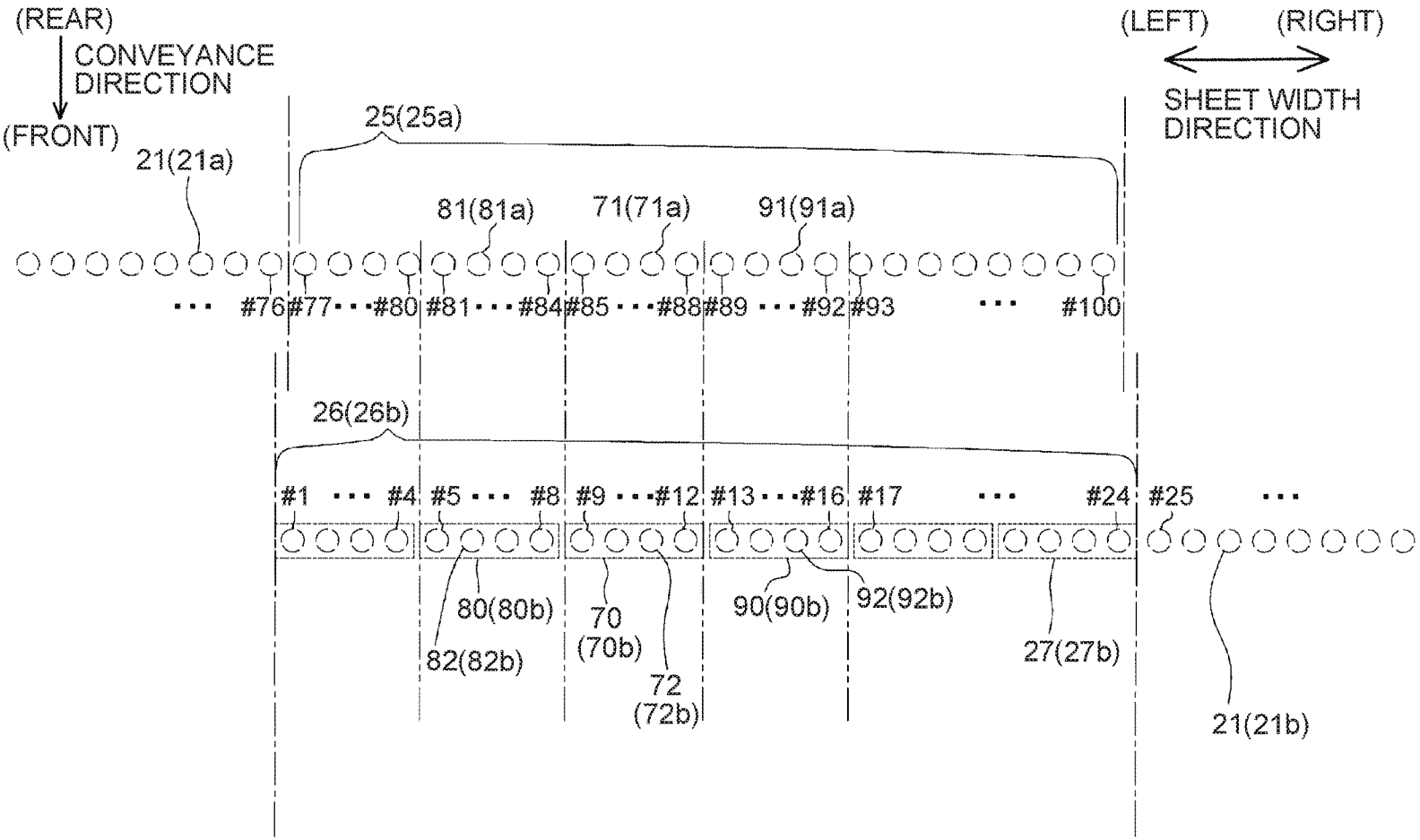
FIG. 11 is a partial enlarged plan view of two head units each including nozzle groups in another alternative embodiment according to one or more aspects of the disclosure.

(3) In other embodiments, for example, ink may be ejected from both of the nozzles 21*a* and the nozzles 21*b* included in another nozzle set 27*b* not corresponding to the optimum nozzle set 70*b*. For example, as illustrated in FIG. 11, ink is ejected from both of the nozzles 21*b* included in a nozzle set 80*b* and their corresponding nozzles 21*a* and from both of the nozzles 21*b* included in a nozzle set 90*b* and their corresponding nozzles 21*a*. The nozzle set 80*b* is positioned to the left, adjacent to the optimum nozzle set 70*b*, and is referred to as the adjacent nozzle set 80*b*. The nozzle set 90*b* is positioned to the right, adjacent to the optimum nozzle set 70*b*, and is referred to as the adjacent nozzle set 90*b*. Hereinafter, the nozzles 21*b* of #5 to #8 constituting the adjacent nozzle set 80*b* are referred to as adjacent nozzles 82*b*, and the nozzles 21*a* of #81 to #84 corresponding to the adjacent nozzles 21*b* are also referred to as adjacent nozzles 81*a*. Hereinafter, the nozzles 21*b* of #13 to #16 constituting the adjacent nozzle set 90*b* are referred to as adjacent nozzles 92*b*, and the nozzles 21*a* of #89 to #92 corresponding to the adjacent nozzles 21*b* are also referred to as adjacent nozzles 91*a*.

Figure 12:
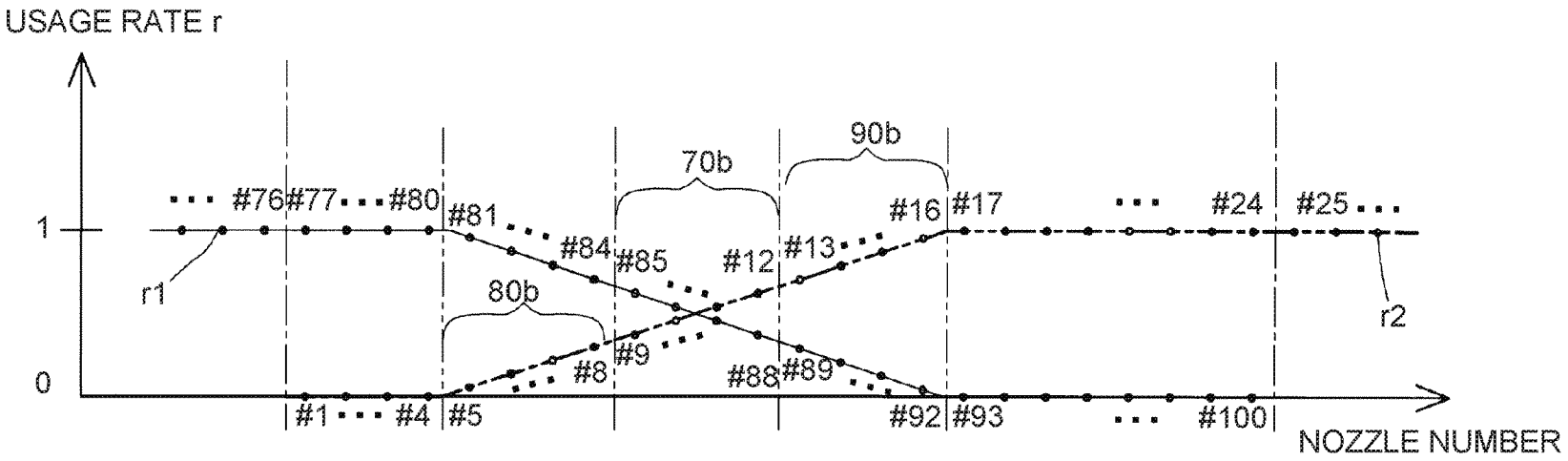
FIG. 12 is a graph showing nozzle usage rates in the two head units of FIG. 11 in the another alternative embodiment according to one or more aspects of the disclosure.

FIG. 12 is a graph showing usage rates r1 of the nozzles 21*a* and usage rates r2 of the nozzles 21*b* in the alternative embodiment. A line representing the usage rates r2 rises linearly from the nozzle 21*b* of #5 toward the nozzle 21*b* of #16. Assuming that an average of the usage rates r2 of four adjacent nozzles 82*b* is an average usage rate R2*x* and an average of the usage rates r2 of four adjacent nozzles 92*b* is an average usage rate R2*y*, the average usage rates R2*x* and R2 satisfies R2*x*<R2<R2*y*. Thus, this configuration may further surely reduce occurrence of density unevenness that may be caused by deviation of landing positions of ink droplets ejected from each nozzle 21*b* and its corresponding nozzle 21*a* relative to each other.

In FIG. 12, the usage rates of the nozzles 21*b* positioned to the right of the optimum nozzle set 70*b* are higher than the usage rate r2 of the rightmost optimum nozzle 72*b* of the optimum nozzles 72*b*, i.e., the usage rate r2 of the nozzle 21*b* of #12. The usage rates of the nozzles 21*b* positioned to the left of the optimum nozzle set 70*b* are lower than the usage rate r2 of the leftmost optimum nozzle 72*b* of the optimum nozzles 72*b*, i.e., the usage rate r2 of the nozzle 21*b* of #9.

In other words, the usage rates r2 of the nozzles 21*b* positioned to the right of the optimum nozzle set 70*b* are higher than the average usage rate R2, and the usage rates r2 of the nozzles 21*b* positioned to the left of the optimum nozzle set 70*b* are lower than the average usage rate R2.

That is, in the nozzle group 26*b*,between any two of the nozzles 21*b* arrayed along the right-left direction, the usage rate r2 of the right nozzle 21*b* is not lower than the usage rate r2 of the left nozzle 21*b*.

Figure 13:
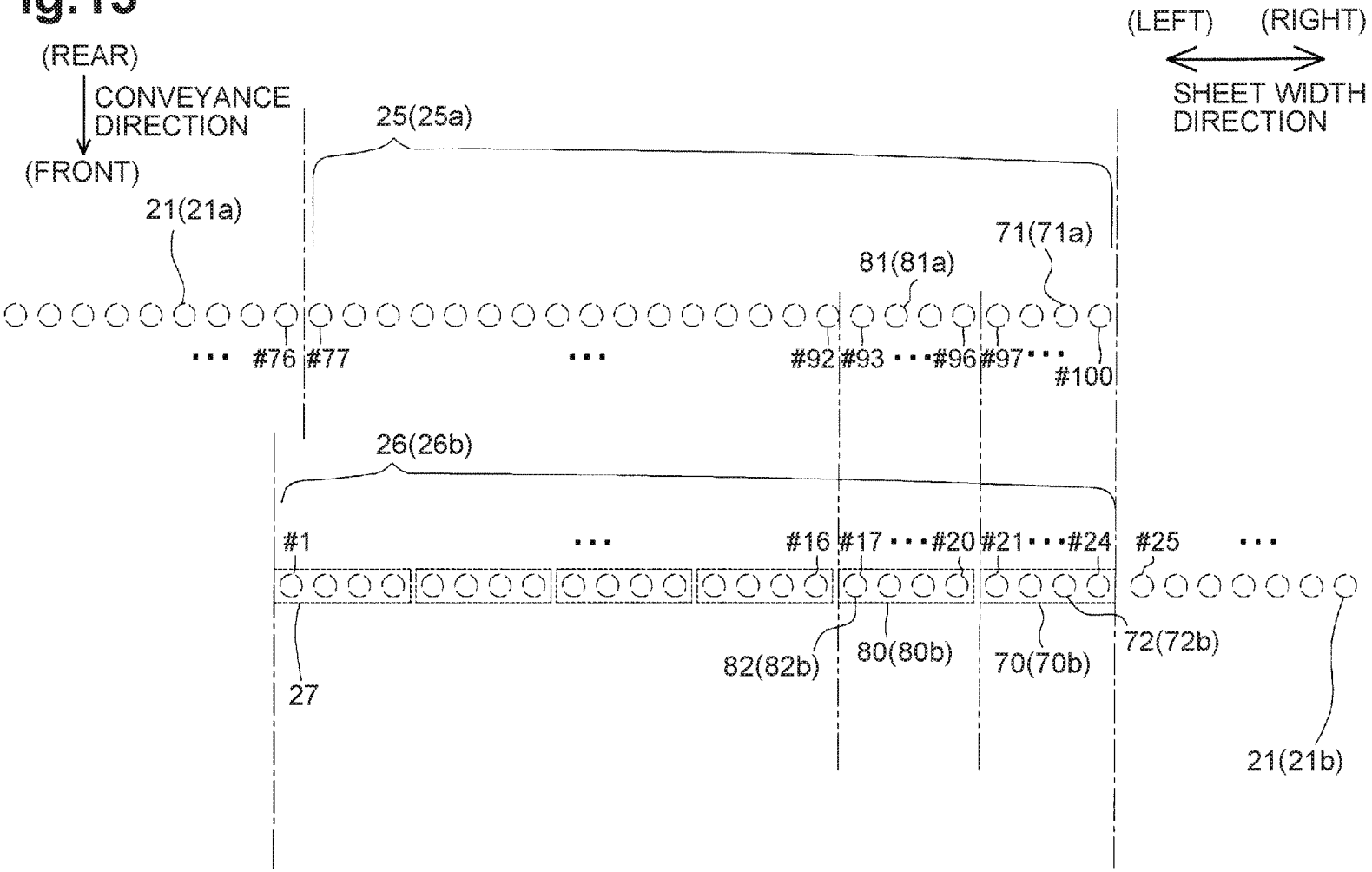
FIG. 13 is a partial enlarged plan view of two head units including nozzle groups in still another alternative embodiment according to one or more aspects of the disclosure.

(4) As illustrated in FIG. 13, the rightmost nozzle set 27 in the nozzle group 26*b* may correspond to the optimum nozzle set 70*b*. In this case, no adjacent nozzle set 90*b* is present to the right of the optimum nuzzle set 70*b*. Therefore, ink is ejected from both of the nozzles 21*b* included in the optimum nozzle set 70*b* and their corresponding nozzles 21*a*, and from both of the nozzles 21*b* included in the adjacent nozzle set 80*b* and their corresponding nozzles 21*a*. The adjacent nozzle set 80*b* is positioned to the left of the optimum nozzle set 70*b*. (4) In a case where the leftmost nozzle set 27 in the nozzle group 26*b* corresponds to the optimum nuzzle set 70*b*, ink is ejected in a similar manner to the above case.

(5) In a case where ink is ejected from both of the nozzles 21*a* of the head unit 11*a* and the nozzles 21*b* of the head unit 11*b*, an image formed on a recording sheet 100 may tend to have lower density due to influence of deviation of landing positions of ink droplets ejected from each nozzle 21*b* of the head unit 11*b* and its corresponding nozzle 21*a* of the head unit 11*a* relative to each other, as compared with a case where ink is ejected from the one or the other of the nozzles 21*a* of the head unit 11*a* and the nozzles 21*b* of the head unit 11*b* only. Therefore, an amount of ink to be ejected from the nozzles 21*b* of the nozzle set 27*b* and their corresponding nozzles 21*a* may be increased.

Figure 14:
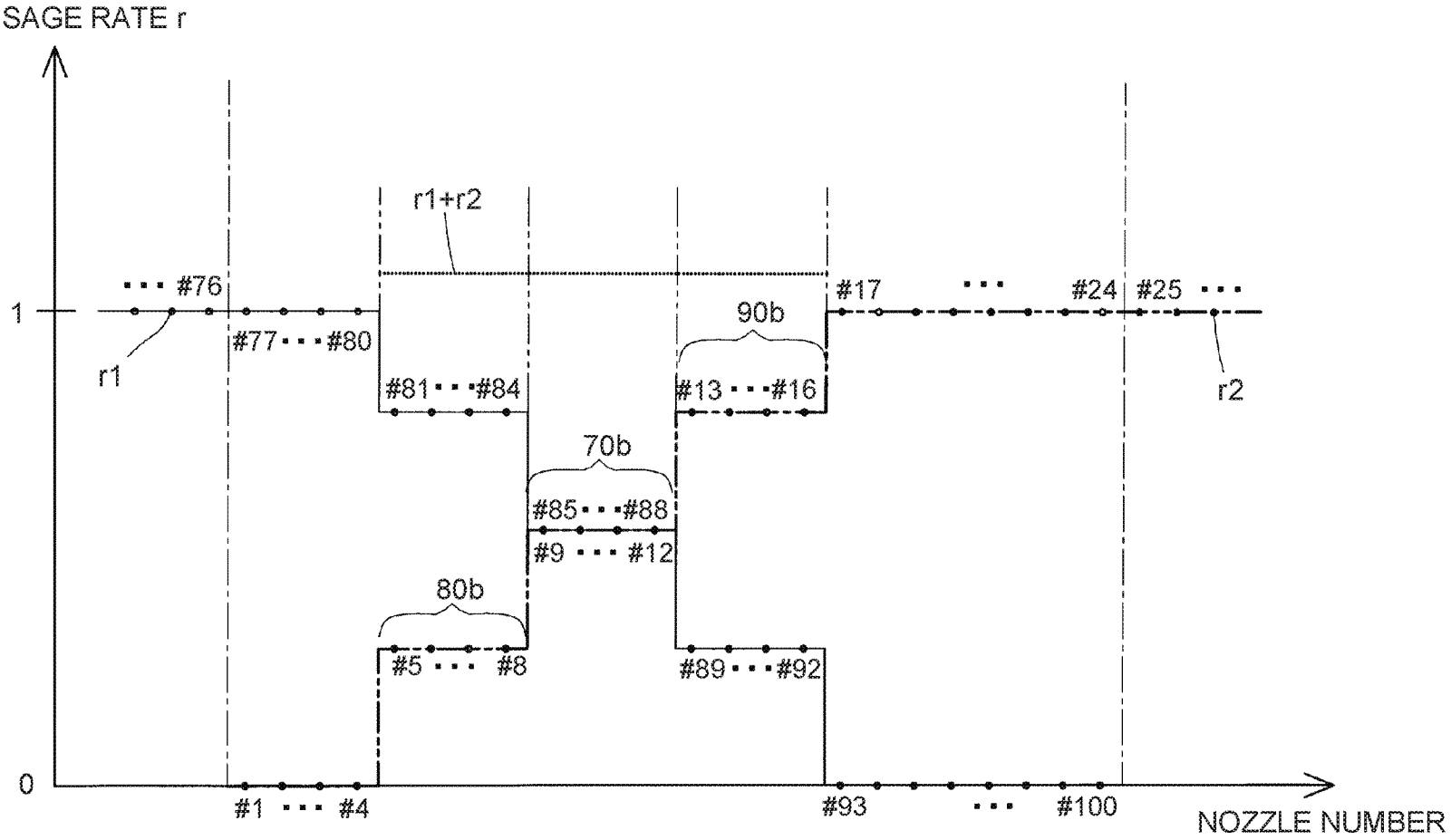
FIG. 14 is a graph showing nozzle usage rates in yet another alternative embodiment according to one or more aspects of the disclosure.

Referring to FIG. 11, this will be described using an example case where ink droplets are ejected from both of the nozzles 21*b* in the optimum nozzle set 70*b* and their corresponding nozzles 21*a* and from both of the nozzles 21*b* in nozzle sets 80*b* and 90*b* adjacent to the optimum nozzle set 70*b* and their corresponding nozzles 21*a*. In this example case, as illustrated in FIG. 14, usage rates r1 of the nozzles 21*a* and usage rates r2 of the nozzles 21*b* change step by step. In FIG. 14, a dashed line indicates a sum of a usage rate r1 of a nozzle 21*b* (e.g., one of the nozzles 21*b* of #5 to #16 included in the optimum nozzle set 70, the adjacent nozzle set 80*b*, or the adjacent nozzle set 90*b*) and a usage rate r2 of its corresponding nozzle 21*a* (e.g., its corresponding nozzle 216*a* of #81 to #92, i.e., the dashed line indicates r1+r2.

In this case, a sum of the average usage rate of the nozzles 21*b* and the average usage rate of the nozzles 21*a* may exceed one (1). More specifically, a sum of the average usage rate of the nozzles 21*b* included in the optimum nozzle set 70*b* and the average usage rate of their corresponding nozzles 21*a* may exceed one. A sum of the average usage rate of the nozzles 21*b* included in the adjacent nozzle set 80*b* and the average usage rate of their corresponding nozzles 21*a* may exceed one. A sum of the average usage rate of the nozzles 21*b* included in the adjacent nozzle set 90*b* and the average usage rate of their corresponding nozzles 21*a* may exceed one. That is, the number of ink droplets to be ejected may be greater than the number of ink droplets determined based on image data. This may be implemented using mask data in which a percentage of the data pieces A included is increased as compared with the mask data 51 and 52 of FIG. 6C. Thus, this configuration may reduce occurrence of insufficient density in an image formed at an area onto which ink droplets are ejected from both of the nozzles 21*a* and the nozzles 21*b*.

Figure 15:
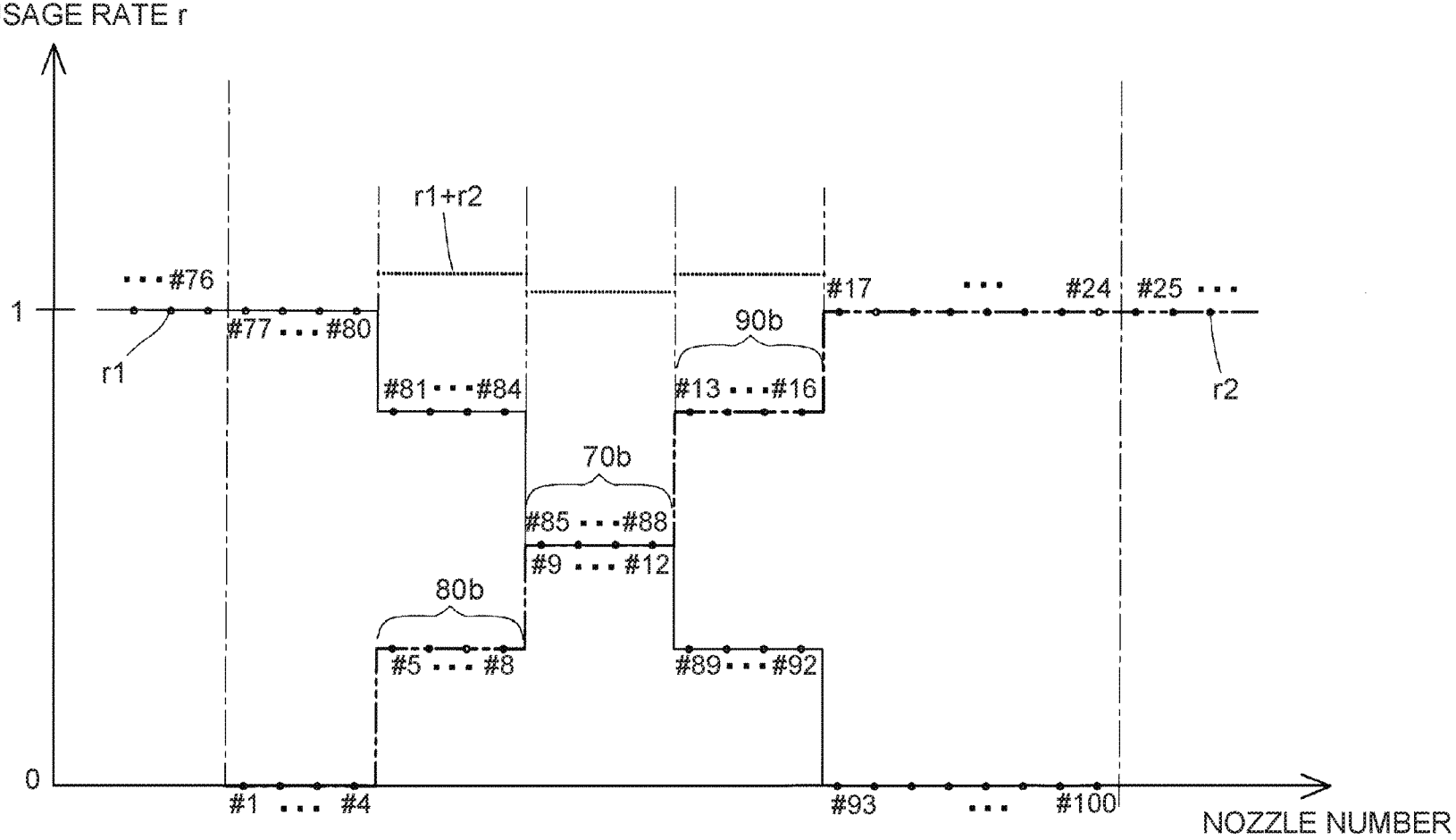
FIG. 15 is a graph showing nozzle usage rates in further alternative embodiment according to one or more aspects of the disclosure.

(6) The degree of misalignment or positional difference between the nozzles 21*b* included in the optimum nozzle set 70*b* and their corresponding nozzles 21*a* is smaller than the degree of misalignment or positional difference between the nozzles 21*b* included in the adjacent nozzle sets 80*b* and their corresponding nozzles 21*a* and between the nozzles 21*b* included in the adjacent nozzle sets 90*b*. Therefore, as illustrated in FIG. 15, the sum of the average usage rate R1 and the average usage rate R2 in the optimum nozzle set 70*b* may be smaller than the sum of the average usage rate R1 and the average usage rate R2 in each of the adjacent nozzle sets 80*b* and 90*b*. That is, the number of ink droplets to be ejected from the nozzles 21*b* of the optimum nozzle set 70*b* and their corresponding nozzles 21*a* in the optimum nozzle set 70*b* may be smaller than the number of ink droplets determined based on image data, as compared with the adjacent nozzle sets 80*b* and 90*b*. This may be implemented using mask data in which a percentage of the data pieces A included is reduced as compared with the mask data 51 and 52 of FIG. 6C.

(7) In the illustrative embodiment, as illustrated in FIG. 5, subsequent to color conversion (e.g., step S202), halftoning (e.g., step S203) is executed. Thereafter, dot data distribution (e.g., step S204) and masking (e.g., step S206) are executed independently. Nevertheless, in other embodiments, for example, masking and halftoning may be executed simultaneously on the density data acquired in color conversion.

(8) In the illustrative embodiment, the controller 7 acquires, as the original data, the image data 300 from the external device 9. Nevertheless, in other embodiments, for example, in response to a user's operation for instructing printing of an image, the external device 9 may generate data described in page description language and transmit the generated data to the printer 1. In this case, the controller 7 of the printer 1 may generate image data 300 represented by RGB values based on the data described in page description language. Subsequent to this, the controller 7 may perform steps S202 to S207. In this case, the data represented by page description language or the image data generated based on page description language may correspond to the original image data. In one example, in a case where the printer 1 includes an interface for reading data from an external memory, e.g., a memory card or a USB memory, or an interface for enabling the printer 1 to communicate with a network, e.g., a local area network, the printer 1 may be configured as described below. The printer 1 may acquire an electronic file directly from the external memory or via the network to which the printer 1 is connected, and the printer 1 may generate the image data 300 corresponding to the resolution of the printer 1, based on the acquired electronic file. In this case, the electronic file or the image data 300 is another example of the original image data.

(9) In other embodiments, for example, the nozzle group 28 may include more than fifty-two nozzles 21.

(10) In other embodiments, for example, the nozzles 21 may be arrayed in two or more rows.

(11) In other embodiments, for example, the pixel data of the dot data 40 may be represented by multiple color levels.

What is claimed is:

1. A printer comprising:

a first head unit being elongate in a longitudinal direction, wherein the first head unit extends from a first end of the first head unit in the longitudinal direction to a second end of the first head unit in the longitudinal direction, the first head unit has a first nozzle group having a plurality of first nozzles arrayed with a first pitch along the longitudinal direction, and the first nozzle group is positioned between a center of the first head unit in the longitudinal direction and the second end of the first head unit in the longitudinal direction; and a second head unit being elongate in the longitudinal direction, wherein the second head unit extends from a third end of the second head unit in the longitudinal direction to a fourth end of the second head unit in the longitudinal direction, the second head unit has a second nozzle group having a plurality of second nozzles arrayed along the longitudinal direction, the second nozzle group is positioned between the third end of the second head unit in the longitudinal direction and a center of the second head unit in the longitudinal direction, the second nozzle group is positioned next to the first nozzle group in a transverse direction orthogonal to the longitudinal direction, the second nozzle group includes a plurality of nozzle sets, each of the plurality of the nozzle sets includes some of the plurality of second nozzles, the second nozzles in each of the plurality of the nozzle sets arrayed with the first pitch along the longitudinal direction, the plurality of the nozzle sets are arrayed with a second pitch along the longitudinal direction, and the second pitch is different from the first pitch.

2. The printer according to claim 1, wherein a difference between the second pitch and the first pitch is one-quarter of the first pitch or smaller.

3. The printer according to claim 1, wherein a difference between the second pitch and the first pitch is 10μm or smaller.

4. The printer according to claim 1, further comprising a controller configured to control one of the plurality of nozzle sets to eject ink at an average usage rate R2, wherein the average usage rate is an average of usage rates of the second nozzles included in the one of the plurality of nozzle sets, and the average usage rate R2 satisfies $0<R2<1$.

5. The printer according to claim 4, wherein the plurality of nozzle sets includes first adjacent nozzle set and second adjacent nozzle set, the first adjacent nozzle set is adjacent to the one of plurality of nozzle sets, the first adjacent nozzle set is positioned between the third end of the second head unit in the longitudinal direction and the one of plurality of nozzle sets, the second adjacent nozzle set is adjacent to the one of plurality of nozzle sets, the second adjacent nozzle set is postioned between the one of plurality of nozzle sets and the fourth end of the second head unit in the longitudinal direction.

6. The printer according to claim 5, wherein the controller further configured to control the first adjacent nozzle set to eject ink at an average usage rate R2*x* and control the second adjacent nozzle set to eject ink at an average usage rate R2*y*, wherein the average usage rate R2*x* is an average of usage rate of the second nozzles included in the first adjacent nozzle set, wherein the average usage rate R2*y* is an average of usage rate of the second nozzles included in the second adjacent nozzle set, and wherein the average usage rates R2, R2*x*, and R2*y* satisfy $R2x<R2<R2y$.

7. The printer according to claim 6, wherein the average usage rate R2*y* satisfy $R2y<1$.

8. The printer according to claim 7, wherein the controller further configured to:

control some of the plurality of first nozzles to eject ink at an average usage rate R1, the some of the plurality of first nozzles are positioned next to the one of the plurality of nozzle sets in the transverse direction orthogonal to the longitudinal direction and control another some of the plurality of first nozzles to eject ink at an average usage rate R1*y*, the another some of the plurality of first nozzles are positioned next to the second adjacent nozzle set in the transverse direction and wherein the average usage rates R1, R2, R1*y* and R2*y* satisfy $R1+R2<R1y+R2y$.

9. The printer according to claim 5, wherein the first adjacent nozzle set includes a first adjacent nozzle adjacent to the one of the plurality of nozzle sets in the longitudinal direction, the second adjacent nozzle set includes a second adjacent nozzle adjacent to the one of the plurality of nozzle sets in the longitudinal direction, and the controller further configured to:

control the first adjacent nozzle to eject ink at a lower rate than the average usage rate R2, and control the second adjacent nozzle to eject ink at a higher rate than the average usage rate R2.

10. The printer according to claim 5, wherein the first adjacent nozzle set includes a first adjacent nozzle adjacent to the one of the plurality of nozzle sets in the longitudinal direction, the second adjacent nozzle set includes a second adjacent nozzle adjacent to the one of the plurality of nozzle sets in the longitudinal direction, the one of the plurality of nozzle sets includes a third adjacent nozzle adjacent to the first adjacent nozzle in the longitudinal direction, the one of the plurality of nozzle sets includes a fourth adjacent nozzle adjacent to the second adjacent nozzle in the longitudinal direction, the controller further configured to:

control the first adjacent nozzle to eject ink at an usage rate r21, control the second adjacent nozzle to eject ink at an usage rate r22, control the third adjacent nozzle to eject ink at an usage rate r23, and control the fourth adjacent nozzle to eject ink at an usage rate r24, and wherein the the usage rates r21, r22, r23 and r24 satisfiy $r21<r23$ and $r24<r22$.

11. The printer according to claim 4, wherein the one of the plurality of nozzle sets includes a nozzle A and a nozzle B, wherein the nozzle A is adjacent to the nozzle B in the longitudinal direction, whererein the nozzle A is positioned between the third end of the second head unit in the longitudinal direction and the nozzle B, wherein the controller is further configured to:

control the nozzle A to eject ink at an usage rate r2A, and control the nozzle B to eject ink at an usage rate r2B, and wherein the usage rates r2A and r2B satisfy $r2A<r2B$.

12. The printer according to claim 4, further comprising a memory configured to store mask data including a plurality of data pieces A, each representing allowance of ink ejection and a plurality of data pieces B, each representing disallowance of ink ejection arrayed therein, the mask data in which a percentage of the data pieces A included in a particular section corresponding to the one of the plurality of nozzle sets included in the second nozzle group is R2, wherein the controller is further configured to:

generate, based on original image data, intermediate image data including pixel data corresponding to each of the second nozzles constituting the second nozzle group;

generate ejection data by masking the intermediate image data using the mask data, the ejection data representing a dot arrangement pattern to be formed using the second nozzles of the second head unit, and output the ejection data to the second head unit.

13. The printer according to claim 1, further comprising a controller configured to:

control the first head unit and the second head unit to print a plurality of test patterns, wherein each of the plurality of test patterns includes a portion formed by some of the first nozzles and one of the plurality of nozzle sets, and wherein the one of the plurality of nozzle sets is different among the plurality of test patterns; and receive a selection of a particular test pattern from the plurality of test patterns.

14. The printer according to claim 13, wherein the controller is configured to control the one of the plurality of nozzle sets corresponding to the particular test pattern to eject ink at an average usage rate R2, wherein the average usage rate is an average of usage rates of the second nozzles included in the one of the plurality of nozzle sets, and wherein the average usage rate R2 satisfies $0<R2<1$.

15. The printer according to claim 1, further comprising a controller configured to:

control the first head unit and the second head unit to print a plurality of test patterns, wherein each of the plurality of test patterns includes a portion formed by some of the first nozzles and one of the plurality of nozzle sets, and wherein a position of the portion in the longitudinal direction is different among the plurality of test patterns; and receive a selection of a particular test pattern from the plurality of test patterns.

16. A head unit comprising:

a nozzle group A including a plurality of nozzles A; and a nozzle group B including a plurality of nozzle sets, each plurality of nozzle sets including of a plurality nozzles B, wherein the head unit is elongate in a longitudinal direction, the head unit extends from a first end of the head unit in the longitudinal direction to second end of the head unit in the longitudinal direction, the plurality of nozzles A are arrayed with a first pich along the longitudinal direction, the nozzle group B is positioned between the first end of the head unit in the longitudinal direction and the nozzle group A, the plurality of nozzles B in each of the plurality of nozzle sets are arrayed with the first pitch along the longitudinal direction, the plurality of nozzles sets are arrayed with a second pitch along the longitudinal direction, and the second pitch is different from the first pitch.

* * * * *